US012156584B2

(12) United States Patent
Wilsey et al.

(10) Patent No.: US 12,156,584 B2
(45) Date of Patent: Dec. 3, 2024

(54) HARNESS ADJUSTMENT ASSEMBLY FOR A USER-WORN ELECTRICAL APPLIANCE AND CONNECTION SYSTEM FOR SAME

(71) Applicant: Emerson Electric Co., St. Louis, MO (US)

(72) Inventors: Gregory Wilsey, Wildwood, MO (US); Mark J. Tomasiak, St. Peters, MO (US); Alex J. Wall, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 235 days.

(21) Appl. No.: 17/445,797

(22) Filed: Aug. 24, 2021

(65) Prior Publication Data

US 2023/0076430 A1 Mar. 9, 2023

(51) Int. Cl.

| | |
|---|---|
| ***A45F 3/14*** | (2006.01) |
| ***A45F 3/04*** | (2006.01) |
| ***A47L 5/36*** | (2006.01) |

(52) U.S. Cl.

CPC ..... *A45F 3/047* (2013.01); *A45F 3/14* (2013.01); *A47L 5/36* (2013.01); *A45F 2003/045* (2013.01); *A45F 2003/146* (2013.01)

(58) Field of Classification Search

CPC ..... A45F 2003/045; A45F 2003/146; A45F 2200/0591; A45F 3/02; A45F 3/04; A45F 3/042; A45F 3/047; A45F 3/08; A45F 3/10; A45F 3/14; A47L 5/36; B65D 11/1833;

(Continued)

(56) References Cited

U.S. PATENT DOCUMENTS

| | | | |
|---|---|---|---|
| 7,350,261 | B2 | 4/2008 | Lee et al. |
| 8,181,833 | B2 | 5/2012 | Wangeby et al. |
| 9,661,965 | B2 | 5/2017 | Fukunaga et al. |

(Continued)

FOREIGN PATENT DOCUMENTS

| | | | | |
|---|---|---|---|---|
| DE | 29713078 | U1 * | 10/1997 | ..... A45C 13/385 |
| DE | 202013004306 | U1 * | 9/2014 | ..... A45F 3/042 |

(Continued)

OTHER PUBLICATIONS

US 10,869,585 B2, 12/2020, Duong et al. (withdrawn)

(Continued)

*Primary Examiner* — Nathan J Newhouse
*Assistant Examiner* — Matthew T Theis
(74) *Attorney, Agent, or Firm* — Armstrong Teasdale LLP

(57) ABSTRACT

Harness adjustment assemblies for user-worn electrical appliances and connection systems for the same are disclosed. In one aspect, a system includes an electrical appliance including a housing defining a recess, a track removably connected to the housing within the recess, a harness adjustment assembly connected to the housing by the track, and a harness assembly configured to be worn by a user of the electrical appliance to facilitate carrying the electrical appliance. The harness adjustment assembly includes an actuator assembly movable and selectively repositionable along the track. The harness assembly is connected to the actuator assembly such that the harness assembly is selectively repositionable relative to the electrical appliance housing upon actuation of the actuator assembly.

21 Claims, 20 Drawing Sheets

(58) Field of Classification Search
CPC .... B65D 2255/20; B65D 7/30; B65D 88/528; E05C 9/22; E05C 9/24
USPC ..... 224/631
See application file for complete search history.

(56) References Cited

U.S. PATENT DOCUMENTS

| | | | | |
|---|---|---|---|---|
| 9,943,714 | B2 | 4/2018 | Steck et al. | |
| 10,702,111 | B2 | 7/2020 | Tomasiak et al. | |
| 10,920,928 | B2 | 2/2021 | Lennings et al. | |
| 10,932,547 | B2 | 3/2021 | Lennings et al. | |
| 2014/0027481 | A1 | 1/2014 | Schultz et al. | |
| 2014/0361058 | A1* | 12/2014 | Gill | A45F 3/047 224/259 |
| 2015/0041512 | A1* | 2/2015 | Rief | H01M 50/247 429/96 |
| 2018/0035857 | A1 | 2/2018 | Fry | |
| 2019/0000287 | A1 | 1/2019 | Duong et al. | |
| 2019/0038095 | A1 | 2/2019 | Fording et al. | |
| 2019/0110650 | A1 | 10/2019 | Mobarek et al. | |
| 2020/0085173 | A1* | 3/2020 | Nordmann | H01M 50/256 |

FOREIGN PATENT DOCUMENTS

| | | | | |
|---|---|---|---|---|
| DE | 112017003412 | T5 * | 3/2019 | H01M 2/1005 |
| FR | 2664139 | A1 * | 1/1992 | |
| WO | WO-2018198133 | A1 * | 11/2018 | A45F 3/047 |

OTHER PUBLICATIONS

DE-202013004306-U1 Translation, Braun W, Sep. 2014 (Year: 2014).*
DE-29713078-U1 Translation, Oct. 1997 (Year: 1997).*
DE-112017003412-T5 Translation, Bylund, Mar. 2019 (Year: 2019).*
FR 2664139 A1 Translation, Philippe, Jan. 1992 (Year: 1992).*
ProTeam Backpack Vacuums, accessed Aug. 18, 2021, available at <https://proteam.emerson.com/en-us/shop/proteam/backpack-vacuum-cleaners>.
PowrFlite Comfort Pro Backpack Vacuum, May 10, 2013, available at <https://www.youtube.com/watch?v=4qXMqpVjqDY>.

* cited by examiner

HARNESS ADJUSTMENT ASSEMBLY FOR A USER-WORN ELECTRICAL APPLIANCE AND CONNECTION SYSTEM FOR SAME

FIELD

The field of the disclosure relates generally to electrical appliances, and in particular, to harness adjustment assemblies for user-worn electrical appliances.

BACKGROUND

Backpack vacuum cleaners are commonly used in commercial cleaning applications because of their convenience and versatility. In many such operations, multiple users use the same backpack vacuum cleaner. Torso dimensions and proportions may vary from one user to the next, and a poorly-fitting backpack harness can improperly distribute the weight of the vacuum cleaner through the harness, causing discomfort to the user.

At least some backpack vacuum cleaners include a mechanism that allows the height of the harness to be adjusted. However, known harness adjustment devices are often configured such that the harness must be fully disassembled and reassembled each time it is adjusted. Additionally, at least some known harness adjustment devices require multiple fasteners (e.g., bolts or screws) to secure the harness adjustment device in place, thereby adding time and complexity to assembly and use.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF SUMMARY

In one aspect, a harness adjustment assembly for a user-worn electrical appliance includes a track and an actuator assembly movably connected to the track. The track is connected to a housing of the electrical appliance and includes a plurality of teeth arranged in at least one row extending in a longitudinal direction. Each pair of adjacent teeth defines an indentation therebetween. The actuator assembly includes at least one locking tab and an actuator connected to the at least one locking tab and configured to move in the longitudinal direction relative to the at least one locking tab. The locking tab is movable between an extended position, in which the locking tab is positioned within one indentation and engaged with at least one tooth defining the indentation, and a retracted position, in which the locking tab is disengaged from the plurality of teeth. Movement of the actuator in the longitudinal direction causes the at least one locking tab to move towards the retracted position and disengage from the plurality of teeth to enable the actuator assembly to move along the track.

In another aspect, a connection system for a user-worn electrical appliance includes a housing of the electrical appliance and a track. The housing has a user-facing side that faces or engages a user when worn by the user, and includes an outer surface, a recessed surface, and a pair of laterally-opposed recess sidewalls that extend into the housing from the outer surface to the recessed surface. The recess sidewalls and the recessed surface at least partially define a recess extending into the housing from the user-facing side. The housing includes a plurality of ribs extending laterally into the recess from each of the pair of recess sidewalls. The track is removably connected to the housing within the recess, and includes a pair of laterally opposed side rails. Each side rail has a plurality of slots defined therein, where each slot is sized, shaped, and positioned to receive one of the plurality of ribs therein. When the electrical appliance is worn by the user, the weight of the electrical appliance causes a reactive force between the plurality of ribs and the side rails to urge the track towards the recessed surface.

In yet another aspect, a system includes an electrical appliance including a housing defining a recess, a track removably connected to the housing within the recess, a harness adjustment assembly connected to the housing by the track, and a harness assembly configured to be worn by a user of the electrical appliance to facilitate carrying the electrical appliance. The harness adjustment assembly includes an actuator assembly movable and selectively repositionable along the track. The harness assembly is connected to the actuator assembly such that the harness assembly is selectively repositionable relative to the electrical appliance housing upon actuation of the actuator assembly.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
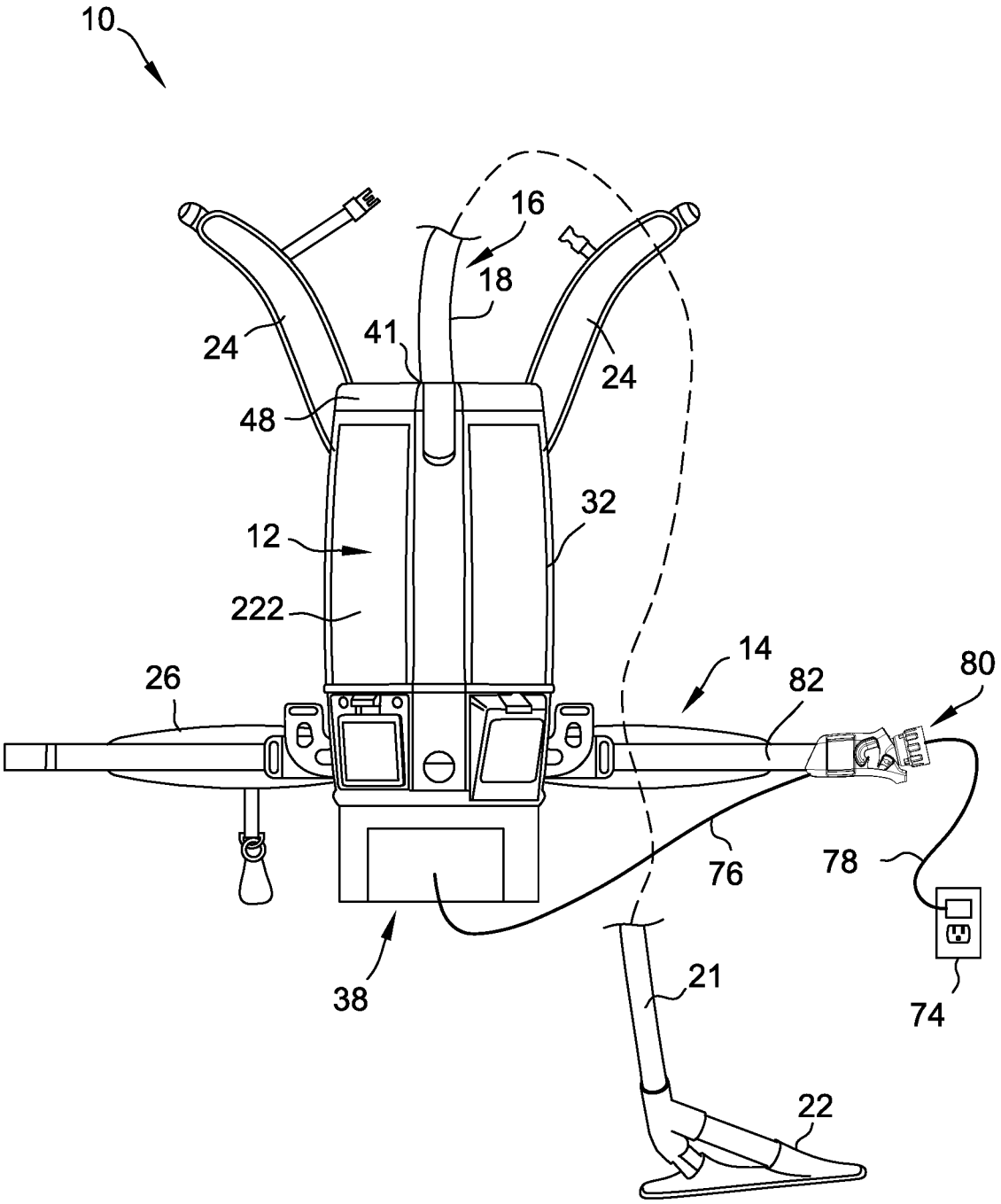
FIG. 1 is a perspective view of an example electrical appliance, illustrated in the form of a backpack vacuum cleaner.

FIG. 1 is a perspective view of an example electrical appliance 10, illustrated in the form of a corded backpack vacuum cleaner. Although the electrical appliance 10 is shown and described herein with reference to a backpack-mounted vacuum cleaner, electrical appliances consistent with this disclosure may be embodied in other types and in other combinations including, for example and without limitation, wet/dry vacuum cleaners, blowers, sprayers, and power tools and equipment.

In the example embodiment, the electrical appliance 10 includes a vacuum cleaner assembly 12 that is carried on a user's back via a harness or backpack assembly 14, and a vacuum conduit 16 connected to the vacuum cleaner assembly 12. The vacuum conduit 16 can generally include any suitable conduit for directing suction and/or forced air generated by the electrical appliance 10, including, for example and without limitation, vacuum hoses, vacuum wands or tubes, surface cleaning tools, and combinations thereof. In the illustrated embodiment, the vacuum conduit 16 includes a hose 18 extending from a top of the vacuum cleaner assembly 12, a vacuum cleaner wand 21 connected to the hose 18, and a vacuum cleaner floor tool 22 connected to a distal end of the vacuum cleaner wand 21.

The harness assembly 14 is sized and shaped to be worn by a user of the electrical appliance 10 (e.g., on the user's back or shoulders) to facilitate carrying the electrical appliance 10 during use. In the illustrated embodiment, the harness assembly 14 includes two shoulder straps 24 and a waist belt 26 for securing the harness assembly 14 and electrical appliance 10 to the torso of a user. In other embodiments, the harness assembly 14 can have any suitable configuration that enables the electrical appliance 10 to function as described herein. As described further herein, the electrical appliance 10 also includes a harness adjustment assembly 300 (shown in FIG. 3) to facilitate adjusting a height of the harness assembly 14.

Figure 2:
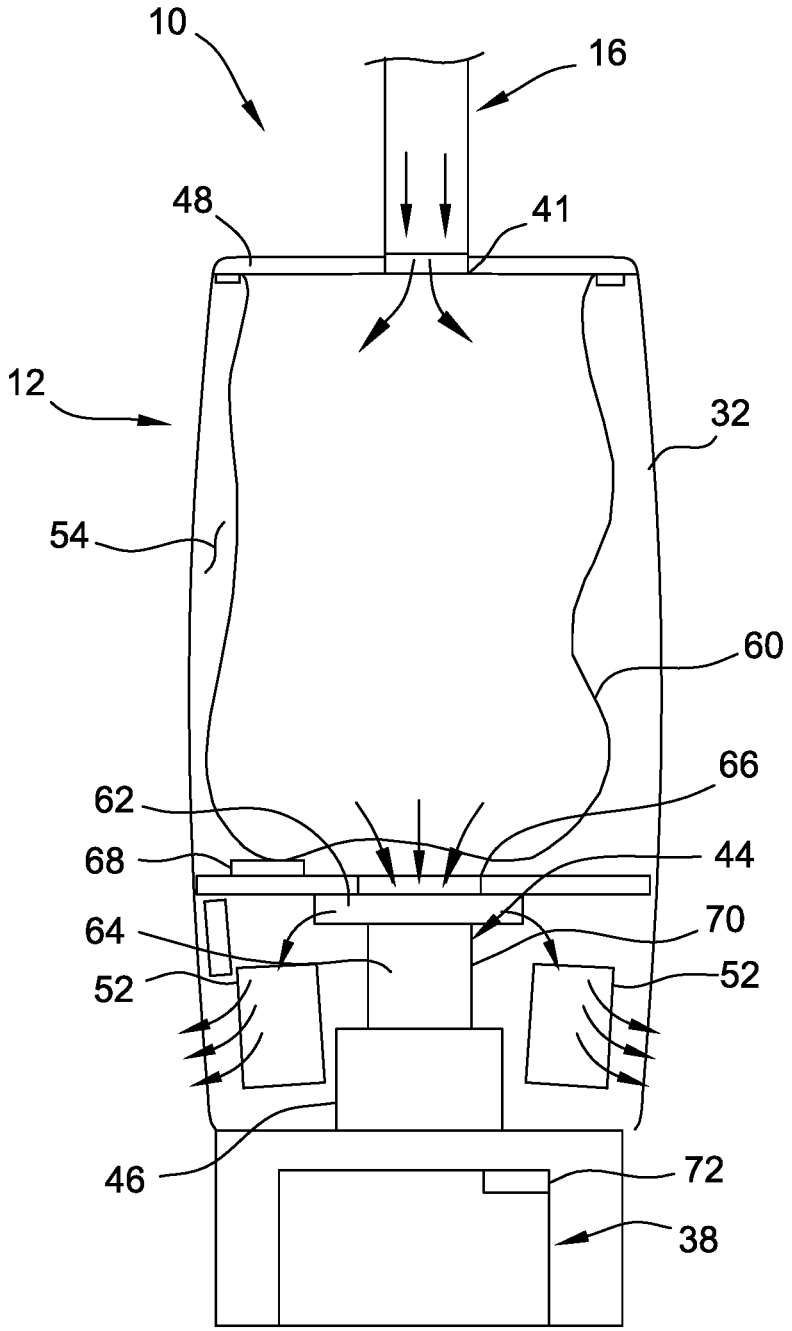
FIG. 2 is a side schematic view of the electrical appliance shown in FIG. 1.

With additional reference to FIG. 2, the vacuum cleaner assembly 12 includes a vacuum cleaner housing 32, a suction unit 44 enclosed within the housing 32, and a controller 46. The housing 32 defines an inlet 41, at least one exhaust or outlet 52, and a debris chamber 54 connected in fluid communication between the inlet 41 and the outlet 52. In the example embodiment, the inlet 41 is defined at a top of the housing 32, and the housing 32 includes two outlets 52 defined adjacent a bottom of the housing 32. In other embodiments, the inlet 41 and the outlet(s) 52 can be defined at any suitable portion of the electrical appliance 10 that enables the electrical appliance 10 to function as described herein. Further, the electrical appliance 10 can include more than or fewer than two outlets 52.

In the illustrated embodiment, the housing 32 includes an access door or lid 48 that provides access to the debris chamber 54, for example, to empty debris collected within the debris chamber 54. The inlet 41 is defined in the lid 48 in the example embodiment. Further, the example housing 32 is adapted to receive a filter 60 within the debris chamber 54 to filter out fine debris and small particles from the air flow through the housing 32. In the illustrated embodiment, the filter 60 is a bag filter, although the electrical appliance 10 can be operable with other types of filters, including, for example and without limitation, cartridge filters.

The suction unit 44 is operable to generate airflow (indicated by arrows in FIG. 2) through the housing 32 from the inlet 41 to the outlet 52 so as to draw debris into the debris chamber 54 through the inlet 41 by way of the vacuum conduit 16 (shown in FIG. 1). The suction unit 44 includes a fan or impeller 62 and a motor 64 operatively connected to the impeller 62 (collectively referred to herein as a "motor assembly") to drive the impeller 62 and generate airflow through the housing 32. The motor assembly is connected to the housing 32 and positioned adjacent the debris chamber 54 such that the impeller 62 receives airflow through an impeller inlet 66 defined by the housing 32. In certain embodiments, the motor assembly can also be adapted to operate in a "reverse" mode in which the motor assembly generates airflow from the outlet 52 to the inlet 41, so as to enable the electrical appliance 10 to operate as a blower.

A suitable power source 74 supplies electrical power to components of the electrical appliance 10, such as the motor 64 and the controller 46, and can generally include any suitable power source that enables the electrical appliance 10 to operate as described herein. Suitable types of power sources include, for example and without limitation, DC power sources, such as battery packs, and AC power sources, such as mains AC electricity from a household or commercial wall outlet. In the illustrated embodiment, the power source 74 is an AC power source provided by a wall outlet, and the vacuum cleaner assembly 12 includes a power cord 76 for electrical connection to the wall outlet (e.g., via an extension cord 78). The power cord 76 is electrically connected to the electrical appliance 10 to supply AC power thereto. The illustrated electrical appliance 10 also includes a power cord restraint assembly 80 attached to the harness assembly 14 (e.g., by a strap 82, coupling link, or other suitable attachment mechanism) that facilitates maintaining connection between the power cord 76 of the electrical appliance 10 and an external power cord (e.g., an extension cord 78 connected to a wall outlet).

The electrical appliance 10 can also include an on-board or portable power source 38, such as a battery or battery pack. In such embodiments, the power cord 76 can be used to supply AC power to the electrical appliance 10, which is converted to DC, to charge the battery, in addition to or as an alternative to supplying power to other components of the electrical appliance 10. In such embodiments, the electrical appliance 10 may be selectively operated in a cordless mode, in which the portable power source 38 is electrically connected to the electrical appliance 10, and a corded mode, in which the power cord 76 is electrically connected to the electrical appliance 10 and supplies AC power to the electrical appliance 10 (e.g., from a wall outlet). Other embodiments may be operated only from a battery or only from AC power.

The illustrated electrical appliance 10 also includes a plurality of sensors 68, 70, 72 connected to the controller 46. The sensors 68, 70, 72 can provide feedback to the controller 46 regarding operation of the electrical appliance 10, and the controller 46 can control the electrical appliance 10 based on feedback received from the sensors 68, 70, 72. Sensors 68, 70, 72 can include, for example and without limitation, proximity sensors, pressure sensors, temperature sensors, voltage sensors, and active or passive current sensors.

Figure 3:
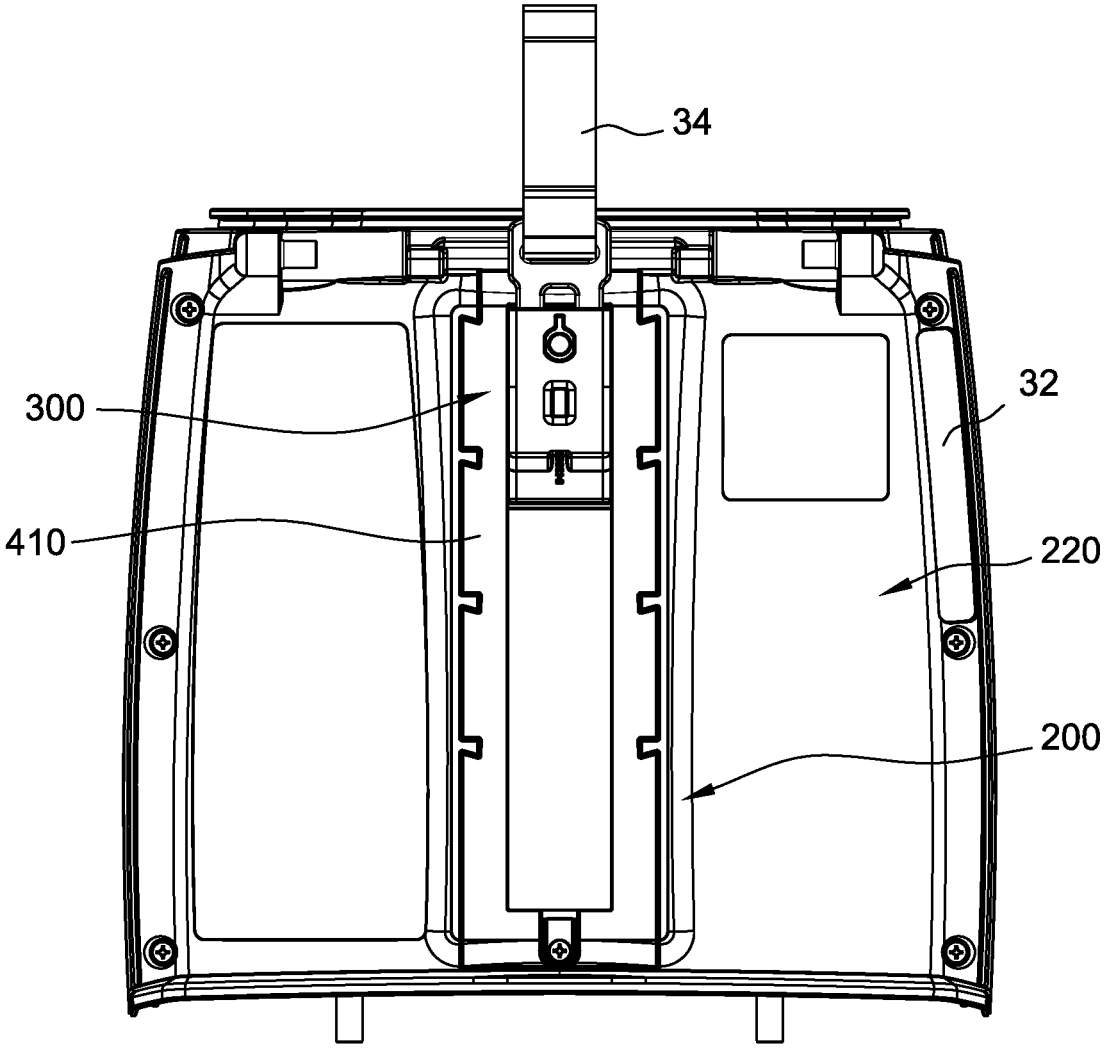
FIG. 3 is a front view of a portion of a housing of the electrical appliance shown in FIG. 1, and a harness adjustment assembly connected to the housing by a connection system.

FIG. 3 is a front view of a portion of the electrical appliance housing 32 shown in FIGS. 1 and 2. The housing 32 of the illustrated embodiment includes a first, user-facing side 220 (shown in FIG. 3), and a second side 222 (shown in FIG. 1) opposite the user-facing side 220. When the electrical appliance 10 is worn by a user, the user-facing side 220 faces or engages the user (e.g., the user's back), and the second side 222 faces away from the user. As shown in FIG. 3, the electrical appliance 10 includes a harness adjustment assembly 300 and a connection system 200 that connects the harness adjustment assembly 300 to the housing 32, specifically, to the user-facing side 220 of the housing 32. As described further herein, the connection system 200 facilitates relatively quick and simple connection of the harness adjustment assembly 300 to the electrical appliance housing 32, and the harness adjustment assembly 300 facilitates adjustment of the harness assembly 14, for example, to accommodate different sized users of the electrical appliance.

Figure 4:
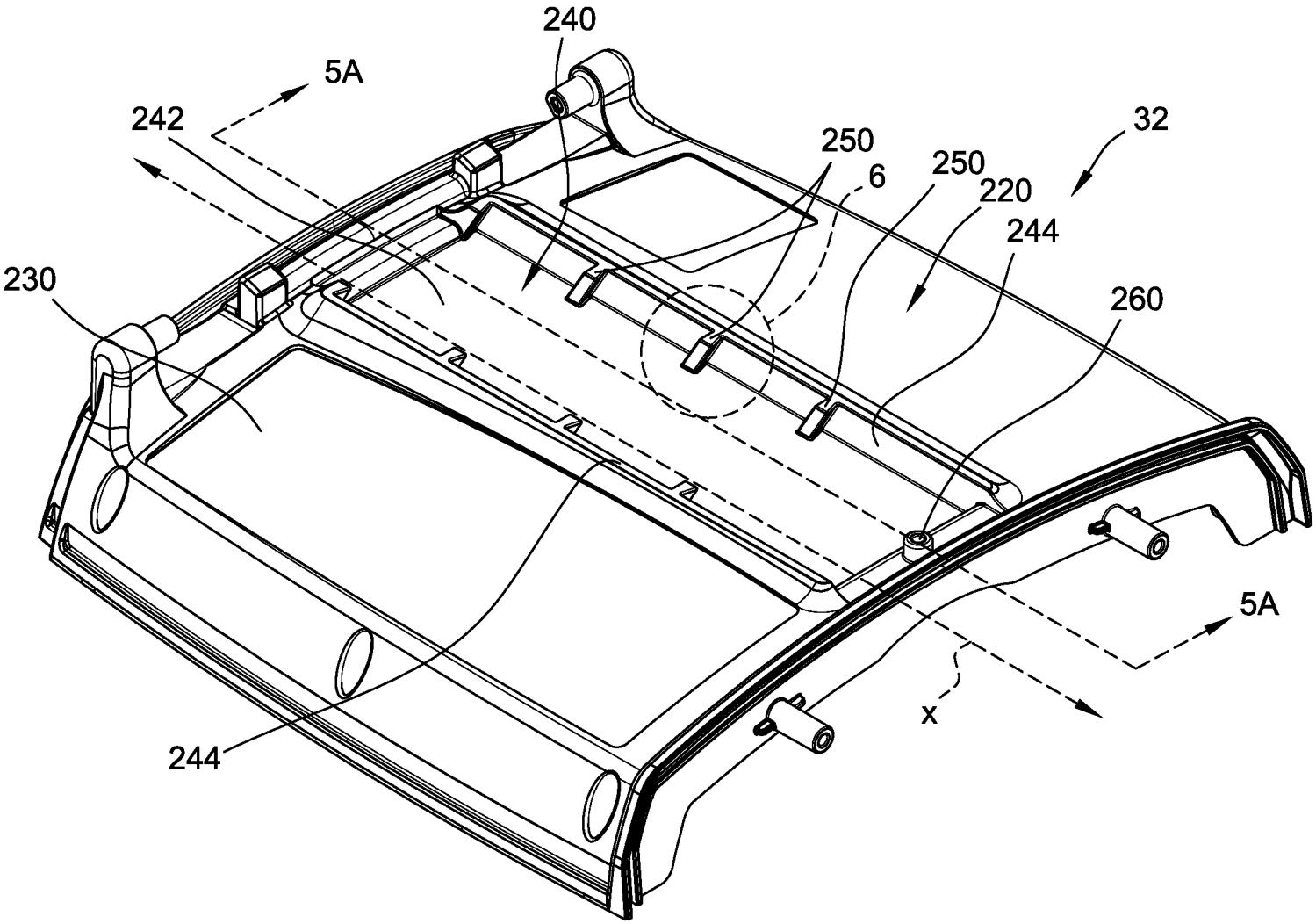
FIG. 4 is a perspective view of the portion of the housing shown in FIG. 3.
Figure 5B:
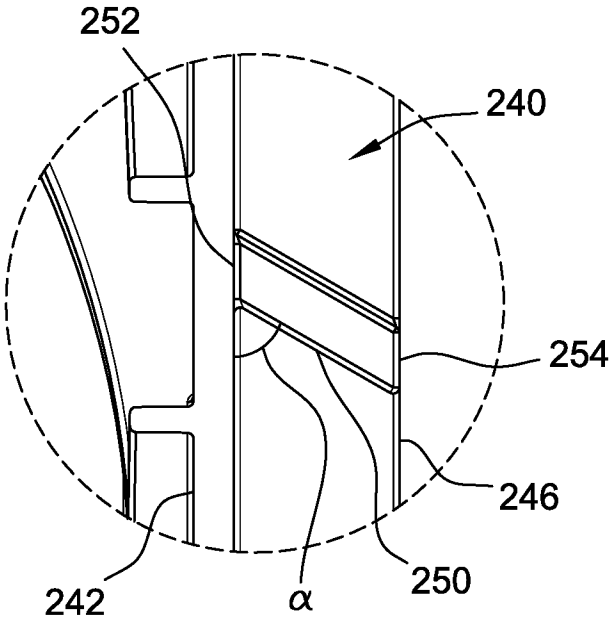
FIG. 5B is an enlarged cross-sectional view of the housing portion shown in FIG. 5A, illustrating one of a plurality of ribs of the housing.
Figure 5A:
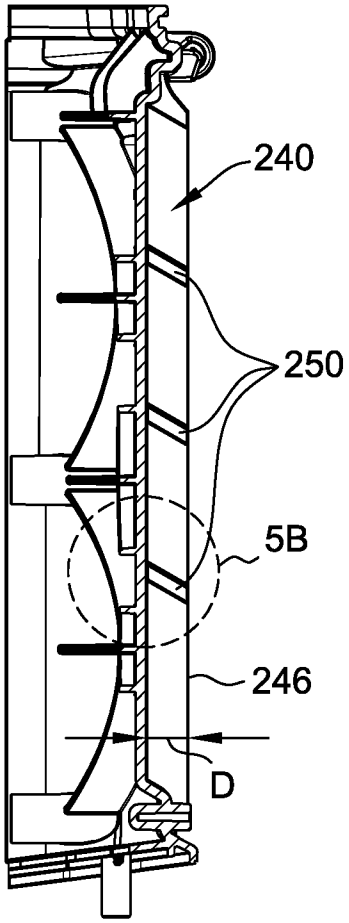
FIG. 5A is a cross-sectional view of the housing portion shown in FIG. 3, taken along line "5A-5A" in FIG. 4.

With additional reference to FIG. 4, the housing 32 includes suitable structure such that the harness adjustment assembly 300 can be connected to the housing 32. In illustrated embodiment, for example, the user-facing side 220 of the housing 32 includes an outer surface 230, a recessed surface 242, and a pair of laterally-opposed recess sidewalls 244 that extend into the housing 32 from the outer surface 230 to the recessed surface 242. The recess sidewalls 244 extend along the housing 32 in a longitudinal direction, indicated by arrow x. The recess sidewalls 244 and the recessed surface 242 at least partially define a recess 240 that extends into the housing 32 from the user-facing side 220. The recess 240 has a depth D (shown in FIG. 5A) extending from a front 246 of the recess 240 adjacent the outer surface 230 to the recessed surface 242.

Figure 6:
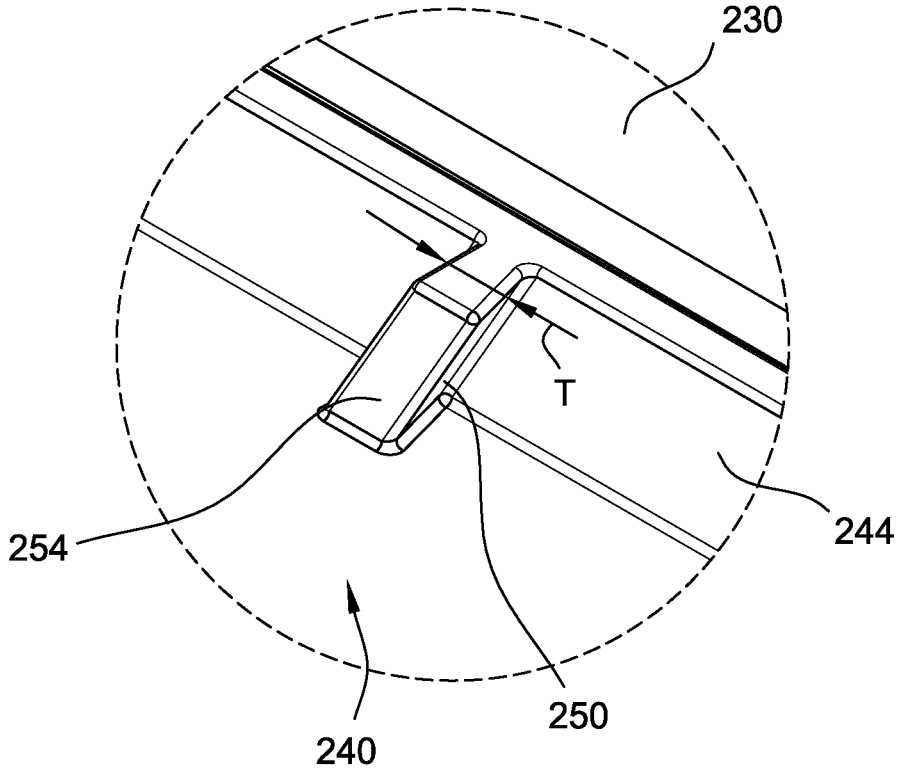
FIG. 6 is an enlarged perspective view of one of the plurality of ribs of the housing shown in FIG. 4.

The housing 32 also includes a plurality of ribs 250 extending laterally into the recess 240 from each of the pair of recess sidewalls 244. With additional reference to FIGS. 5A and 5B, each rib 250 extends at a downward angle $\alpha$, measured relative to the recessed surface 242, from a first end 252 proximate the recessed surface 242 to a second end 254 positioned proximate the front 246 of the recess 240. In some embodiments, the downward angle $\alpha$ is in the range of 30° to 75°. With additional reference to FIG. 6, each rib 250 extends laterally inward into the recess 240. In the illustrated embodiment, each rib 250 has a tapered increasing thickness T as the rib 250 extends from the recess sidewall 244 laterally into the recess 240. That is, the end of the rib 250 closer to the center of the recess 240 has a greater thickness T than the end of the rib 250 connected to the recess sidewall 244. In other embodiments, the thickness T of each rib 250 can be constant. In some embodiments, the housing 32 defines a first fastener opening 260 for receiving a fastener 280 (FIG. 8) therein. The first fastener opening 260 can extend through the entire thickness of the housing 32, or it can terminate within the housing 32. The first fastener opening 260 can be threaded or unthreaded. The plurality of ribs 250 and the recess 240 both form part of the connection system 200.

Figure 7:
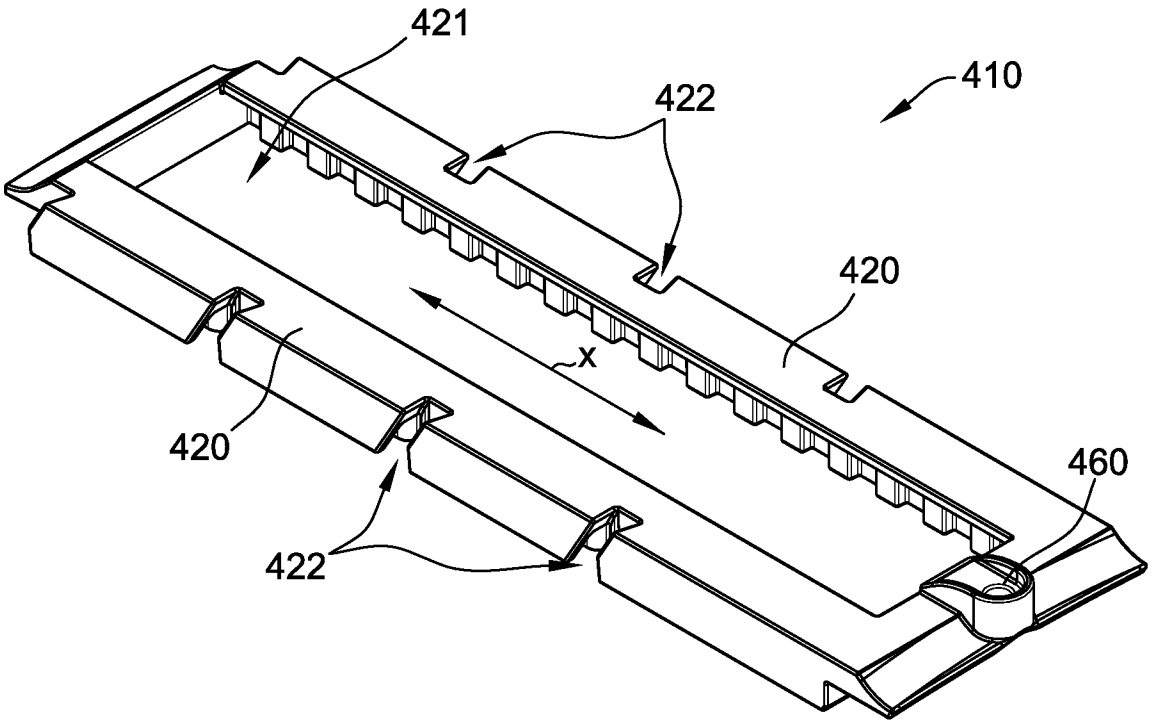
FIG. 7 is a perspective view of a track of the connection system shown in FIG. 3.

The connection system 200 further includes a track 410 removably connected to the housing 32 within the recess 240. With reference to FIG. 7, the track 410 includes a pair of laterally opposed side rails 420 extending in the longitudinal direction x. The side rails 420 are laterally spaced from one another to define a longitudinally extending channel 421 therebetween. As described further herein, the channel 421 is sized and shaped to receive a portion of the harness adjustment assembly 300 therein to connect the harness adjustment assembly 300 to the housing 32.

Each side rail 420 has a plurality of slots 422 defined therein. Each slot 422 is sized, shaped, and positioned to receive one of the plurality of ribs 250 therein when the connection system 200 is assembled. In the illustrated embodiment, each slot has a tapered increasing width as the slot 422 extends laterally inward from an outer edge of the side rail 420 towards the channel 421. The tapered increasing thickness T of each rib 250 and the corresponding tapered increasing width of each slot 422 strengthen the connection between the track 410 and the housing 32 by pulling the track 410 toward and into engagement with the recess sidewalls 244 when the track 410 experiences an upward force. In some embodiments, the track 410 defines a second fastener opening 460 extending through the track 410 for receiving a fastener 280 (FIG. 8) therein. The second fastener opening 460 can be threaded or unthreaded.

Figure 8:
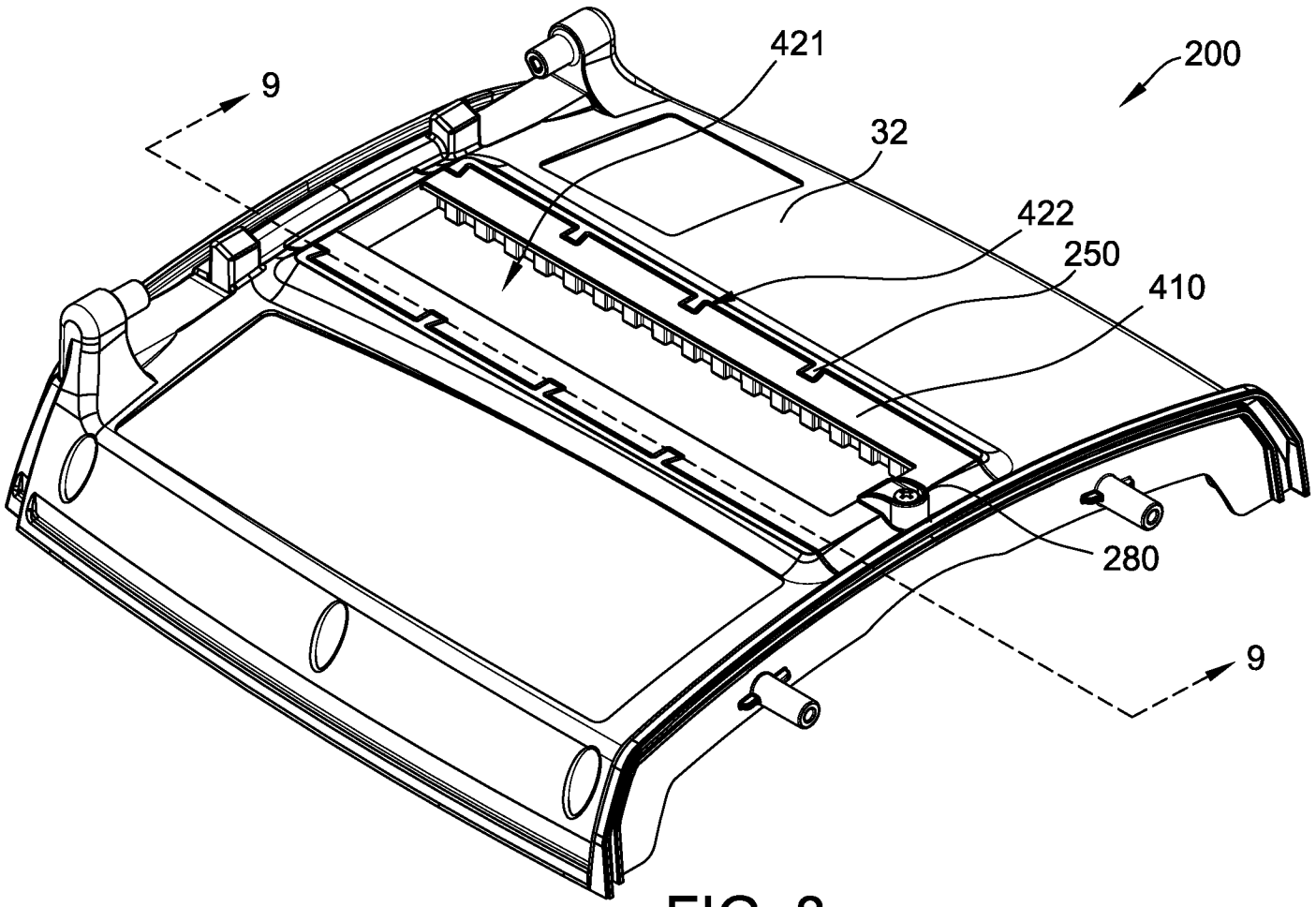
FIG. 8 is a perspective view of the connection system shown in FIG. 3.
Figure 9:
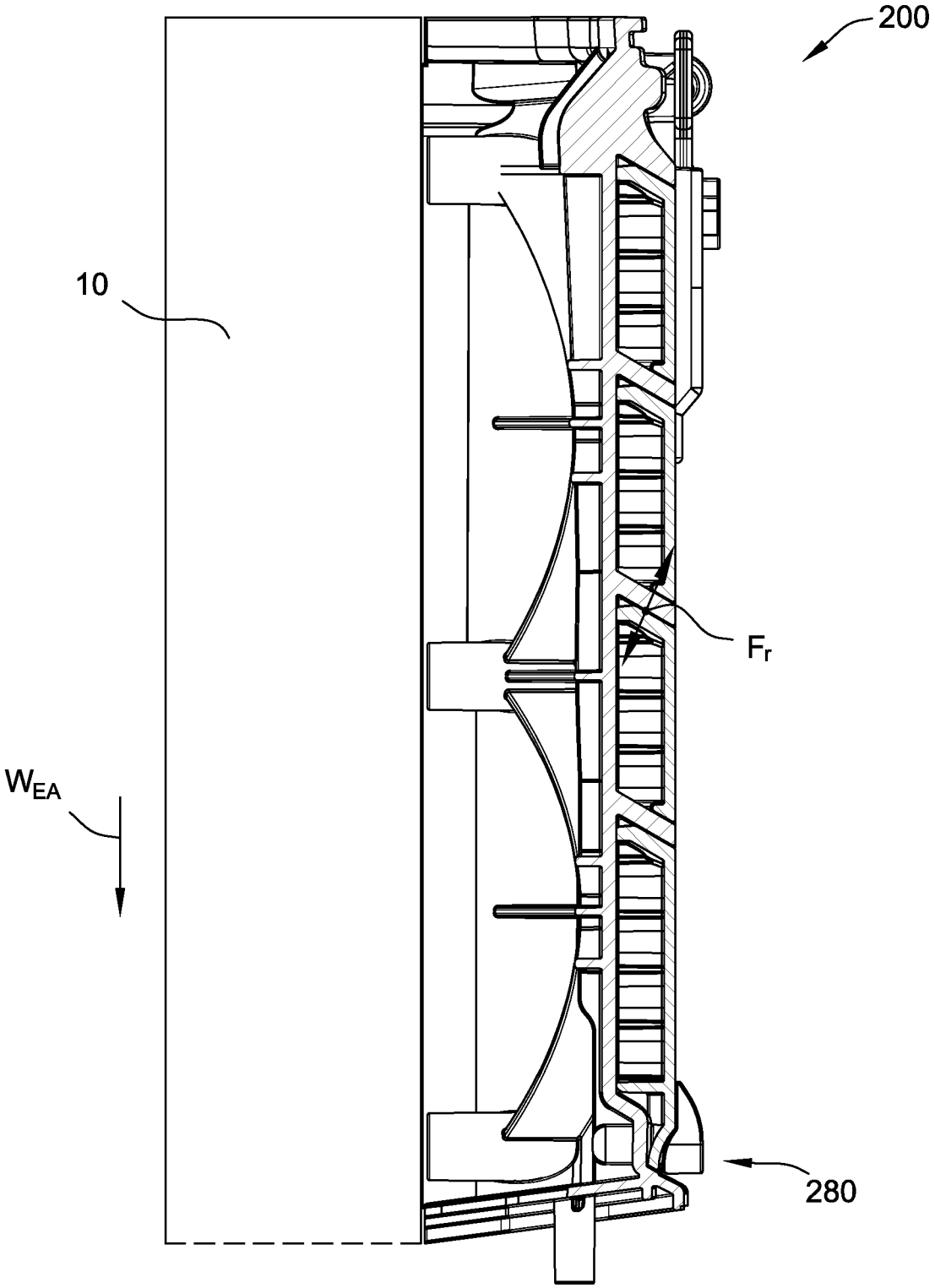
FIG. 9 is a cross-sectional view of the connection system shown in FIG. 8, taken along line "9-9".

FIGS. 8-9 illustrate the connection system 200 in an assembled state. As shown in FIGS. 8-9, each rib 250 of the housing 32 is received by one of the slots 422 of the track 410. When the electrical appliance 10 is worn by a user, the downward gravitational force $W_{EA}$ of the electrical appliance 10 is distributed across the plurality of ribs 250 and carried by the side rails 420 of the track 410. Because the ribs 250 are oriented at a downward angle $\alpha$, the reactive forces $F_r$ between the plurality of ribs 250 and the side rails 420 are oriented at an oblique angle relative to the longitudinal direction x and the recessed surface 242. As a result, the reactive forces $F_r$ between the ribs 250 and the side rails 420 of the track 410 urge the track 410 towards the recessed surface 242, and thereby facilitate securing the track 410 to the housing 32.

The configuration of the housing 32 (e.g., the recess 240 and the downward-angled ribs 250) and the track 410 (e.g., the corresponding angled slots in the side rails 420) facilitates connecting the track 410 to the electrical appliance 10 by reducing or minimizing the number of fasteners needed to secure the track 410 to the housing 32. For example, because the track 410 will be naturally urged or biased towards the recessed surface 242 and held in place when the electrical appliance 10 is worn by a user, the track 410 can be connected to the housing 32 with only a single fastener 260 in some embodiments. For example, the second fastener opening 460 can be aligned with the first fastener opening 260 in the housing 32, and the fastener 280 can be inserted through the first and second fastener openings 260, 460 to secure the track 410 to the housing 32. In yet other embodiments, the track 410 can be connected to the housing 32 without any additional fasteners (e.g., screws, bolts, magnetic couplings, etc.). In some embodiments, for example, the track 410 and the housing 32 can include mating indentation and molded snap features that interlock such that no fasteners are needed to secure the track 410 to the housing 32.

Figure 19A:
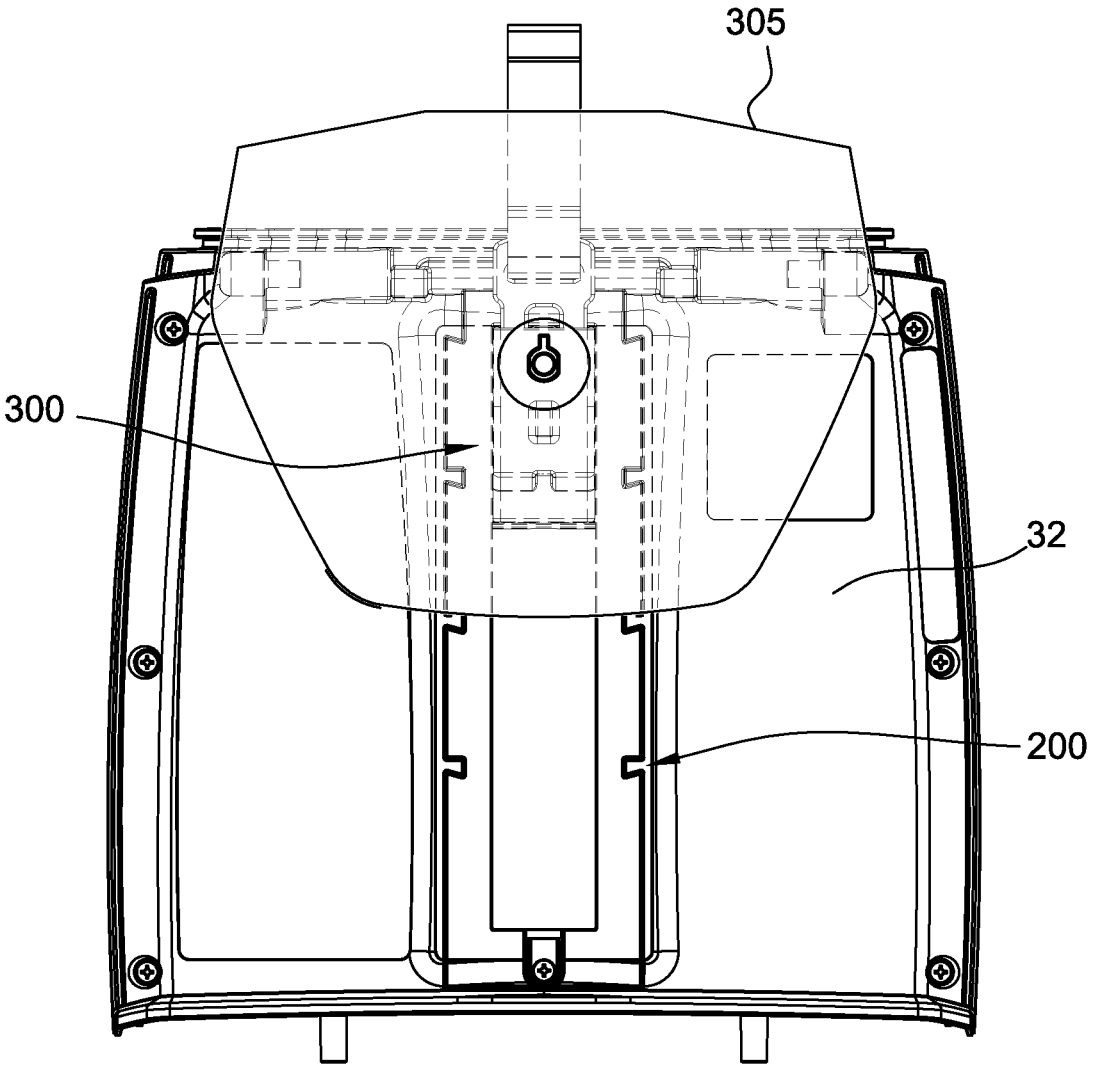
FIG. 19A is a front view of the harness adjustment assembly shown in FIG. 3, with the actuator assembly positioned at a first height.
Figure 19B:
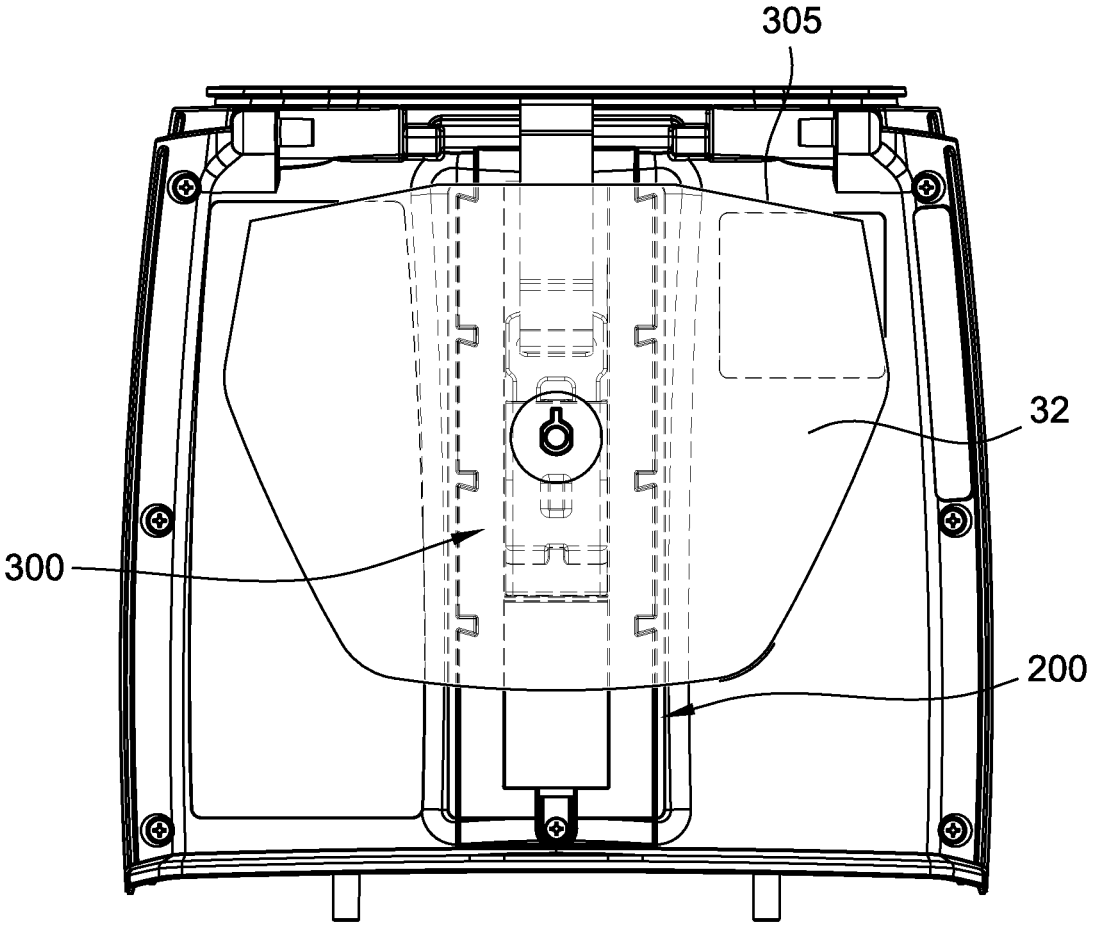
FIG. 19B is a front view of the harness adjustment assembly shown in FIG. 3, with the actuator assembly positioned at a second height.

The track 410 also forms part of the harness adjustment assembly 300, which also includes an actuator assembly 310 that is movably connected to the track 410. As described further herein, the actuator assembly 310 connects to an upper mounting plate 305 (shown in FIGS. 19A and 19B) adapted for connection to the harness assembly 14, and is selectively moveable or repositionable within the track 410 to facilitate adjusting a height or position of the harness assembly 14 (e.g., a height or position of the shoulder straps 24).

Figure 10:
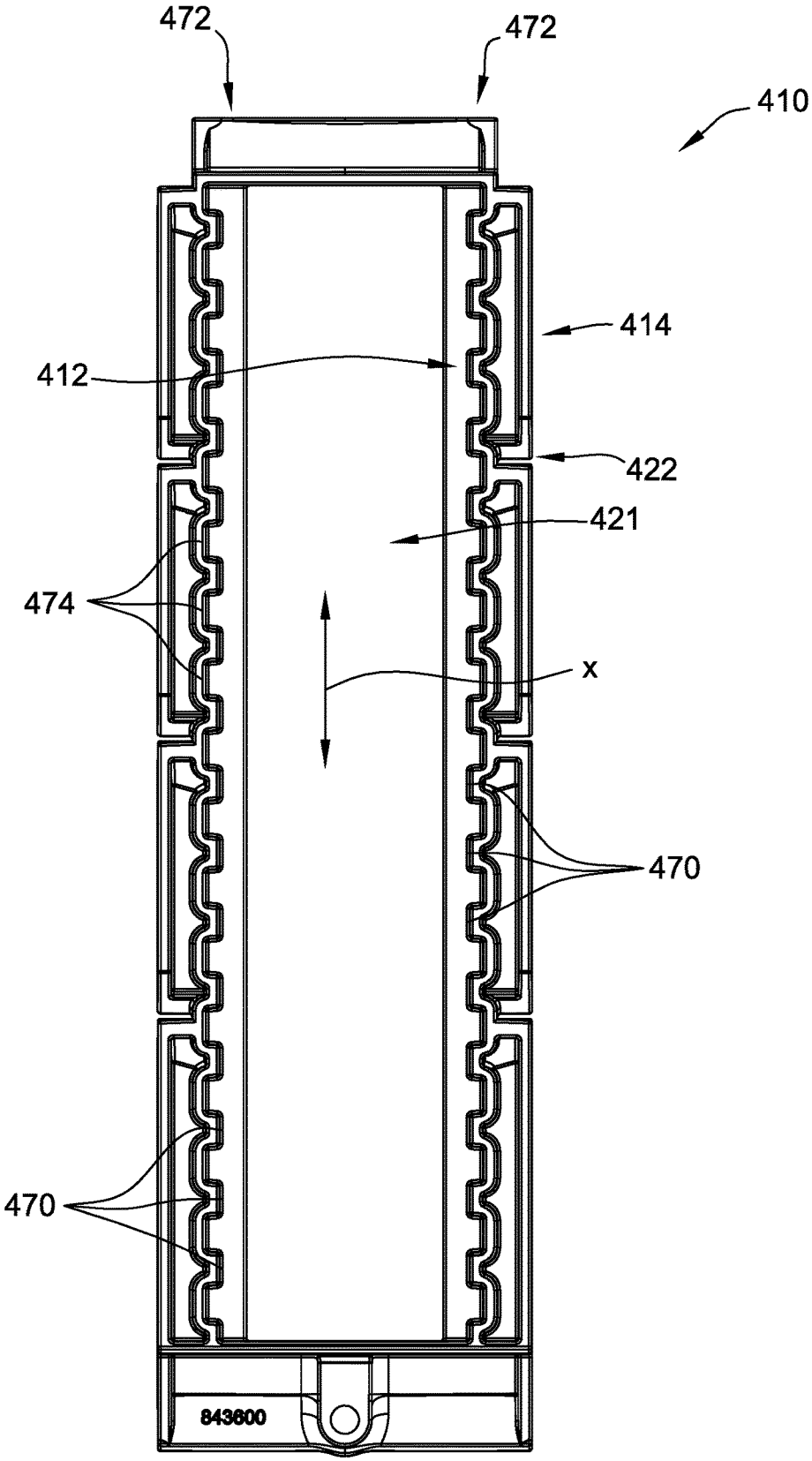
FIG. 10 is a rear view of the track shown in FIG. 7.

With additional reference to FIG. 10, each side rail 420 of the track 410 includes a plurality of teeth 470 arranged in a row 472 extending in the longitudinal direction x. The teeth 470 are arranged on a lateral interior side 412 of the side rails 420, located opposite a lateral exterior side 414 of the side rails 420 in which the slots 422 are defined. Each tooth 470 extends laterally inward into the channel 421 defined by the track 410. As shown in FIG. 10, a recess or indentation 474 is defined between each pair of adjacent teeth 470. Each of the indentations 474 is sized and shaped to receive a portion of the actuator assembly 310 therein. The illustrated embodiment includes two rows of teeth 470 and indentations 474 (one row located on each of the side rails 420), although other embodiments may include a different number of rows of teeth 470 and indentations 474. In some embodiments, for example, the track 410 may include only a single row of teeth 470 and indentations 474.

Figure 11:
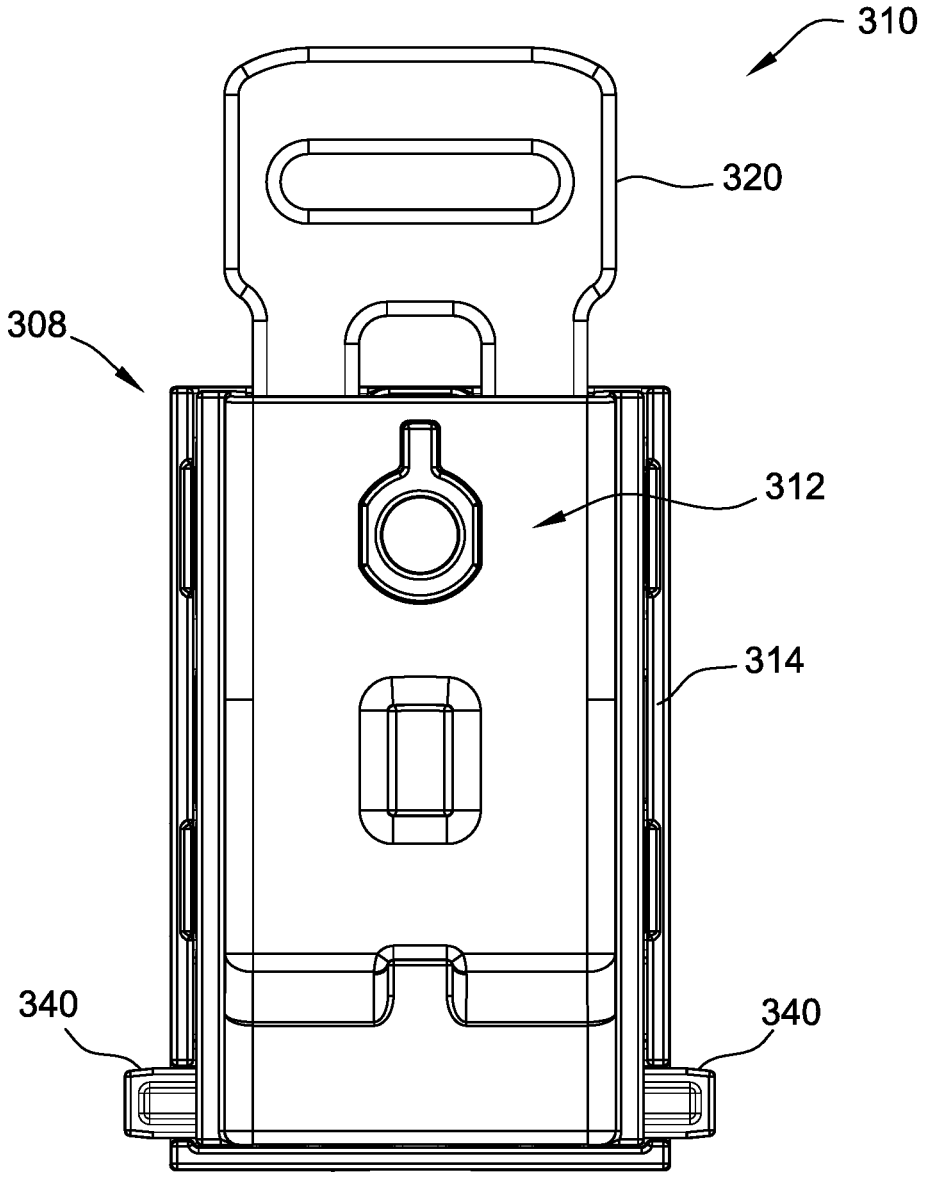
FIG. 11 is a front view of an actuator assembly of the harness adjustment assembly shown in FIG. 3.

With additional reference to FIG. 11, the actuator assembly 310 includes an actuator housing 308, an actuator 320 moveably connected to the actuator housing 308, and at least one locking tab 340. Each locking tab 340 moves upon actuation of the actuator 320 between an extended position, in which the locking tab 340 is positioned within one of the indentations 474 and engaged with at least one of the teeth 470 defining the indentation 474, and a retracted position, in which the locking tab 340 is disengaged from the plurality of teeth 470. The illustrated embodiment includes two locking tabs 340, although other embodiments may include a different number of locking tabs 340.

The actuator housing 308 includes a front actuator housing portion 312 and a rear actuator housing portion 314 that is removably connected to the front actuator housing portion 312. With additional reference to FIG. 12A, the front actuator housing portion 312 includes one or more deflectable tabs 316 disposed thereon to connect the front actuator housing portion 312 to the rear actuator housing portion 314.

Figure 12B:
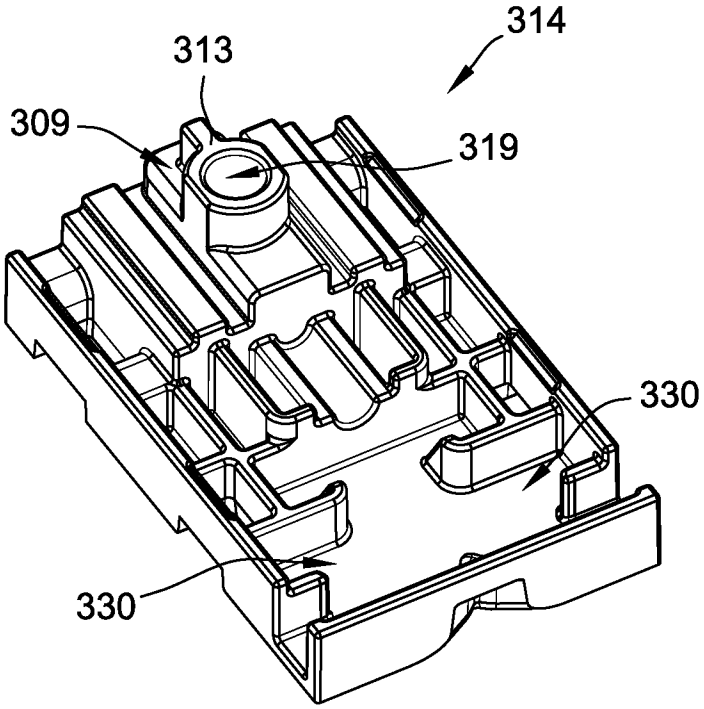
FIG. 12B is a perspective view of a rear actuator housing portion of the actuator assembly shown in FIG. 11.
Figure 12A:
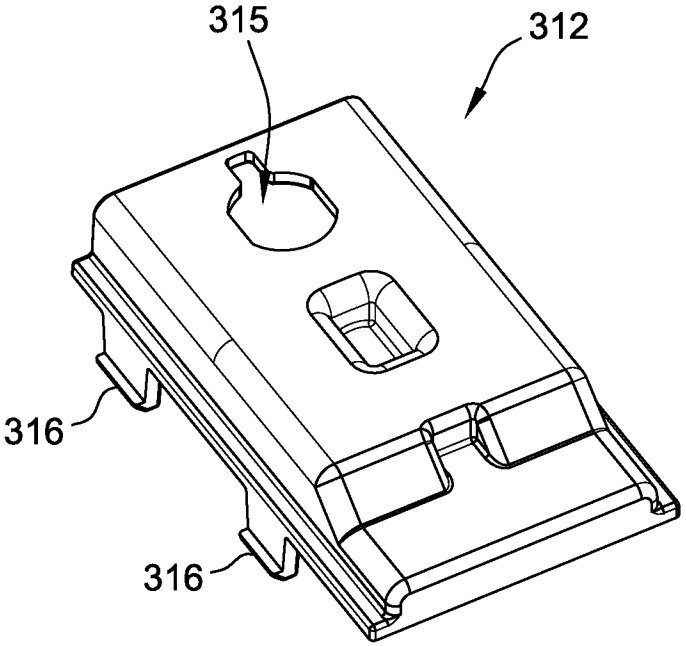
FIG. 12A is a perspective view of a front actuator housing portion of the actuator assembly shown in FIG. 11.

The rear actuator housing portion 314 also includes an attachment feature 309 for connecting the mounting plate 305 (shown in FIGS. 19A and 19B) of the harness assembly 14 to the actuator assembly 310. In the illustrated embodiment, the attachment feature 309 includes a keyed shaft 313 protruding from the rear actuator housing portion 314. The keyed shaft 313 protrudes through an opening 315 defined in the front actuator housing portion 312 when the actuator housing 308 is assembled. The keyed shaft 313 is sized and shaped complementary to an opening (not shown) in the mounting plate 305 such that the keyed shaft 313 can be inserted through the mounting plate opening to connect the mounting plate 305 to the actuator assembly 310. In some embodiments, the keyed shaft 313 and mounting plate opening are sized and shaped to form a friction fit connection. Additionally or alternatively, the keyed shaft 313 may include a fastener opening 319, as illustrated in FIG. 12B, to receive a fastener therein to secure the mounting plate 305 to the actuator assembly 310. The fastener opening 319 may be threaded or unthreaded.

Figure 13B:
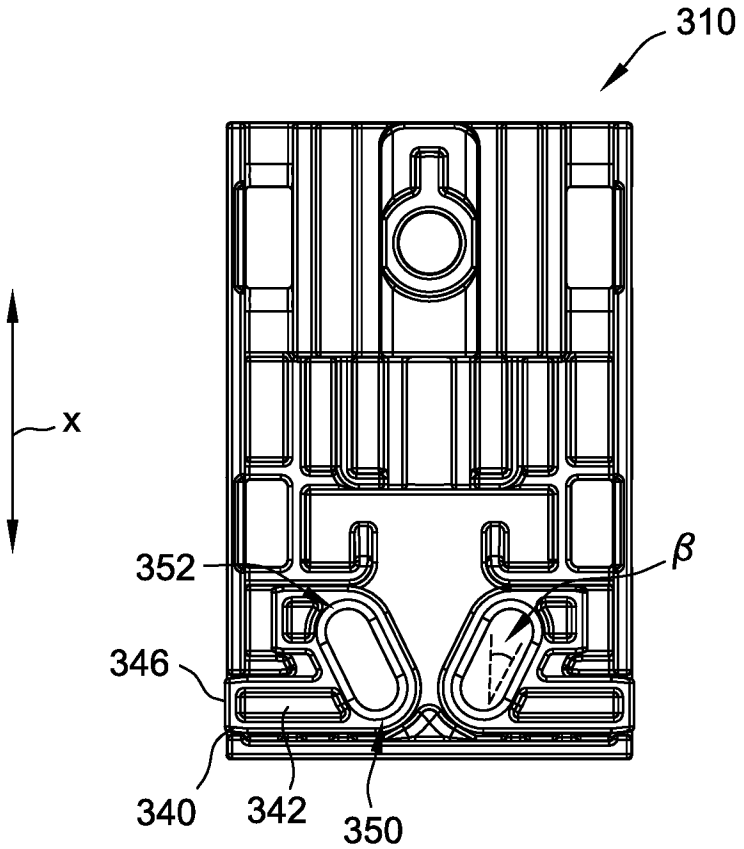
FIG. 13B is a front view of the rear actuator housing and locking tabs shown in FIG. 13A, where the locking tabs are illustrated in a retracted position.
Figure 13A:
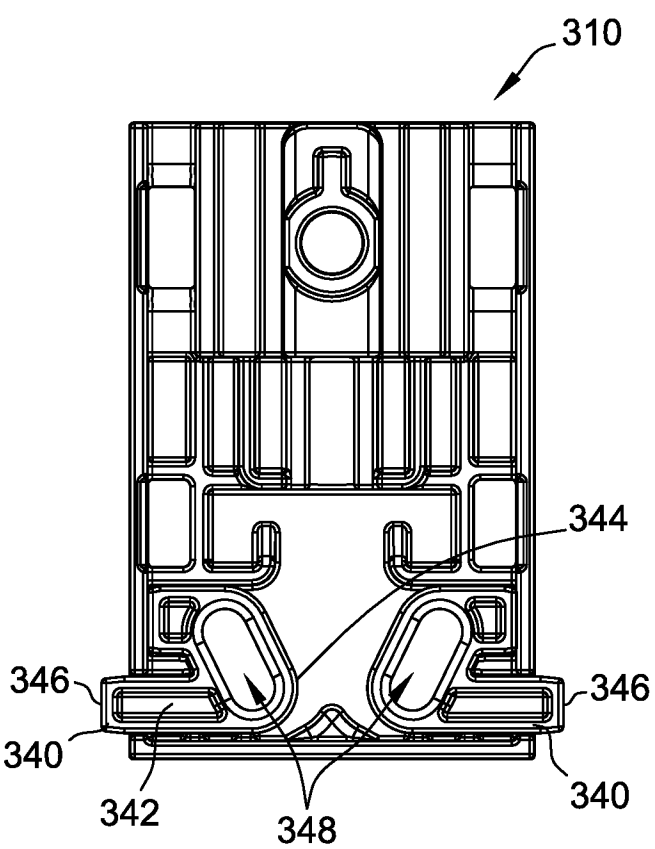
FIG. 13A is a front view of the rear actuator housing portion shown in FIG. 12B including locking tabs disposed therein, where the locking tabs are illustrated in an extended position.

The actuator housing 308 also defines one or more cavities 330 for receiving the locking tabs 340 therein. The cavities 330 can be defined between the front and rear actuator housing portions 312, 314, as in the illustrated embodiment, or the cavities 330 can be wholly defined within one of the front actuator housing portion 312 or the rear actuator housing portion 314. As shown in FIGS. 13A and 13B, each locking tab 340 is received within one of the cavities 330 such that the locking tabs 340 are disposed between the front and rear actuator housing portions 312, 314 when the actuator assembly 310 is assembled.

The illustrated actuator assembly 310 includes two locking tabs 340, although other embodiments may include any suitable number of locking tabs 340 that enables the actuator assembly 310 to function as described herein, including, for example and without limitation, one, three, four, or more locking tabs 340. Each locking tab 340 includes a body 342 extending from a proximal end 344 to a tab-shaped distal end 346. The body 342 of each locking tab 340 has an elongate channel 348 defined therein adjacent the proximal end 344. The channel 348 extends from a first end 350 to a second end 352, and is oriented at an oblique channel angle β relative to the longitudinal direction x. In some embodiments, the channel angle β can range from 15° to 45°. The channels 348 are sized and shaped to receive a portion of the actuator 320.

Each locking tab 340 is moveable between the extended position (FIG. 13A), in which the distal end 346 of the locking tab 340 protrudes from the actuator assembly 310, and the retracted position (FIG. 13B), in which the distal end 346 of the locking tab 340 is retracted and disposed within the actuator assembly 310. The locking tabs 340 are moved between the extended position and the retracted position by actuation of the actuator 320.

Figure 14B:
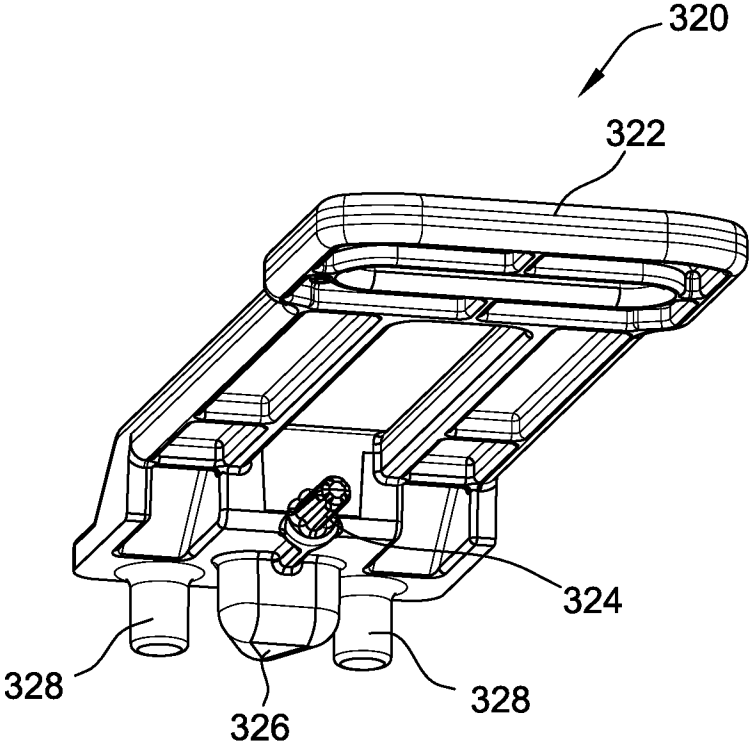
FIG. 14B is another perspective view of the actuator shown in FIG. 14A.
Figure 14A:
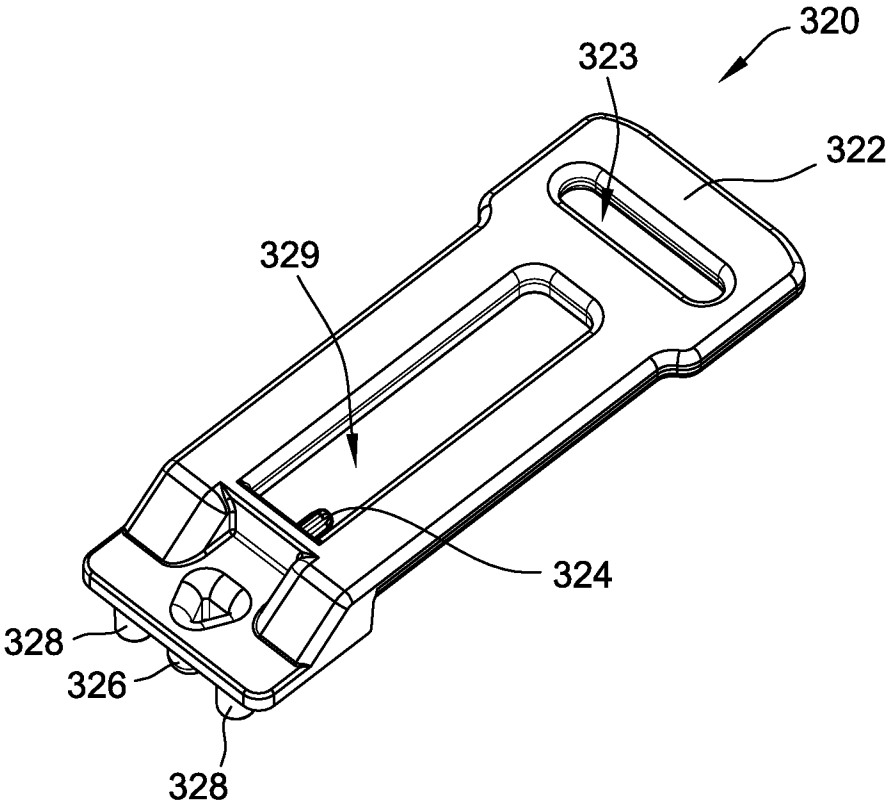
FIG. 14A is a perspective view of an actuator of the actuator assembly shown in FIG. 11.

With additional reference to FIGS. 14A and 14B, the actuator 320 includes a handle 322, a stem 324, a wedge 326, and at least one pin 328. The illustrated embodiment includes two pins 328, one corresponding to each of the locking tabs 340, although other embodiments may include any suitable number of pins 328 that enables the actuator 320 to function as described herein, including, for example and without limitation, one, three, four, or more pins 328. Each of the pins 328 is sized and shaped to be received within one of the locking tab channels 348 when the actuator assembly 310 is assembled as shown, for example, in FIGS.

15A and 15B. The wedge 326 may be substantially triangular in shape such that two of its sides are oriented at the same angle as the angled, proximal end 344 of the locking tabs 340.

Figure 16A:
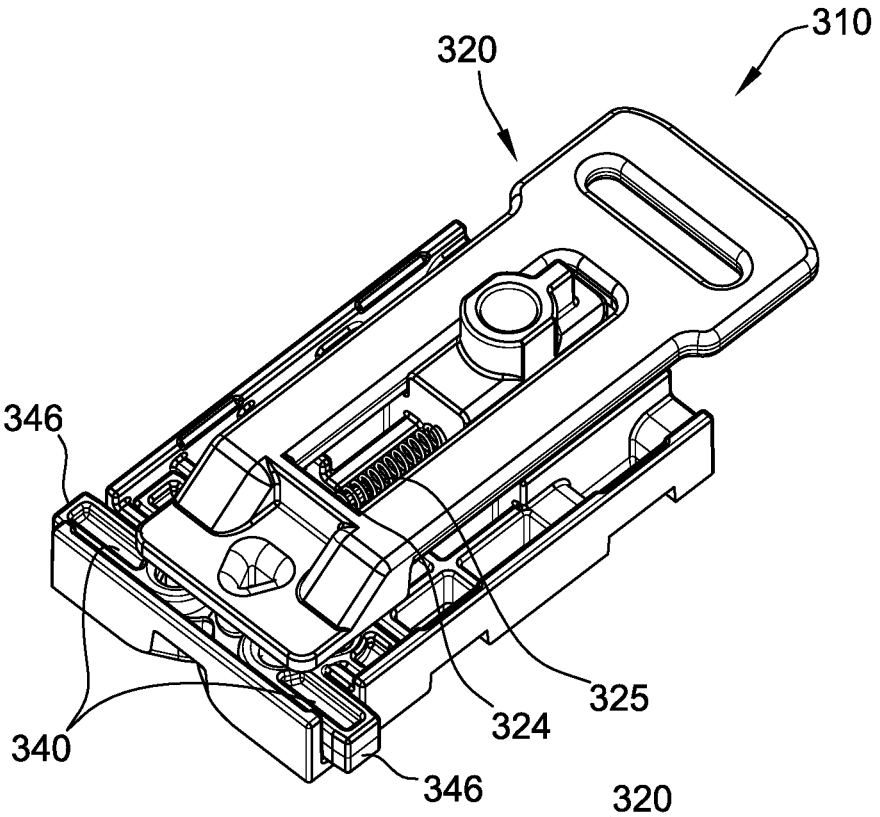
FIG. 16A is a perspective view of the actuator assembly shown in FIG. 11 with the locking tabs in the extended position, where the front actuator housing is omitted for clarity.
Figure 16B:
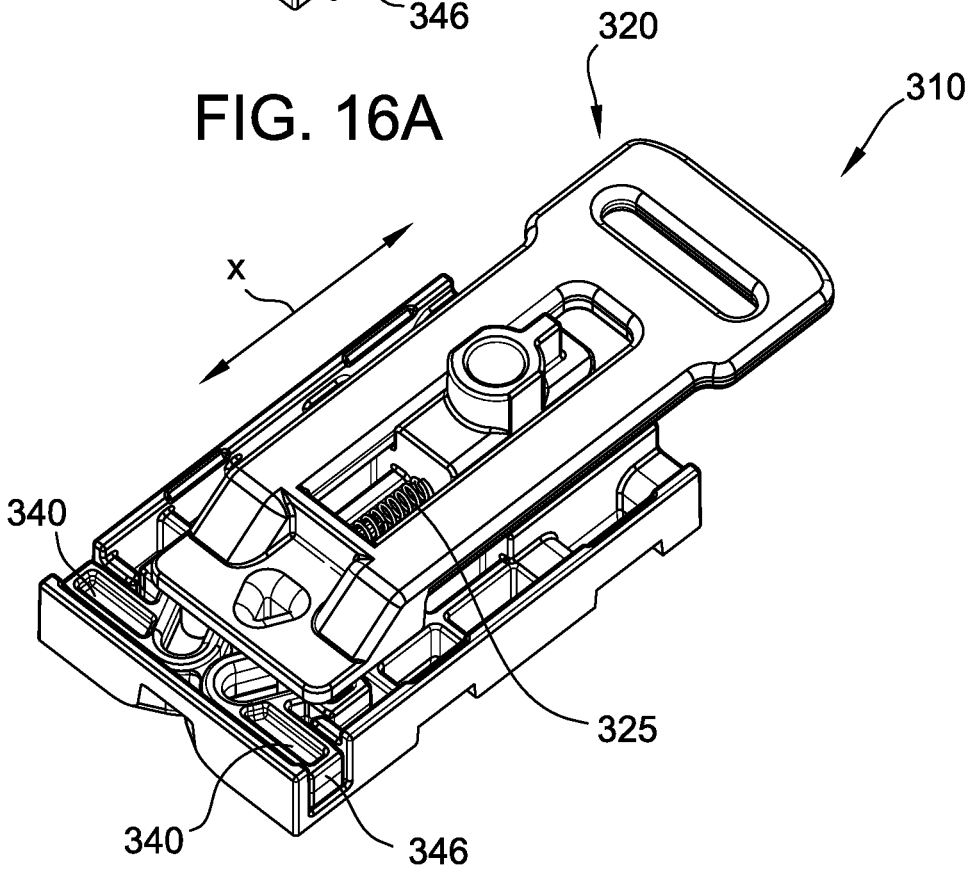
FIG. 16B is a perspective view of the actuator assembly shown in FIG. 16A with the locking tabs in the retracted position.

As described further herein, the actuator 320 is moveable between a first, initial position (shown in FIG. 16A) and a second, actuated position (shown in FIG. 16B) to move the locking tabs 340 between the extended position and the retracted position.

The handle defines a first opening 323 for receiving a strap 34 (FIG. 3) that can be used to apply a force to move the actuator 320 in the longitudinal direction x. The actuator 320 additionally defines a second opening 329 through which the attachment feature 309 of the rear actuator housing portion 314 extends when the actuator 320 is actuated.

Figure 15B:
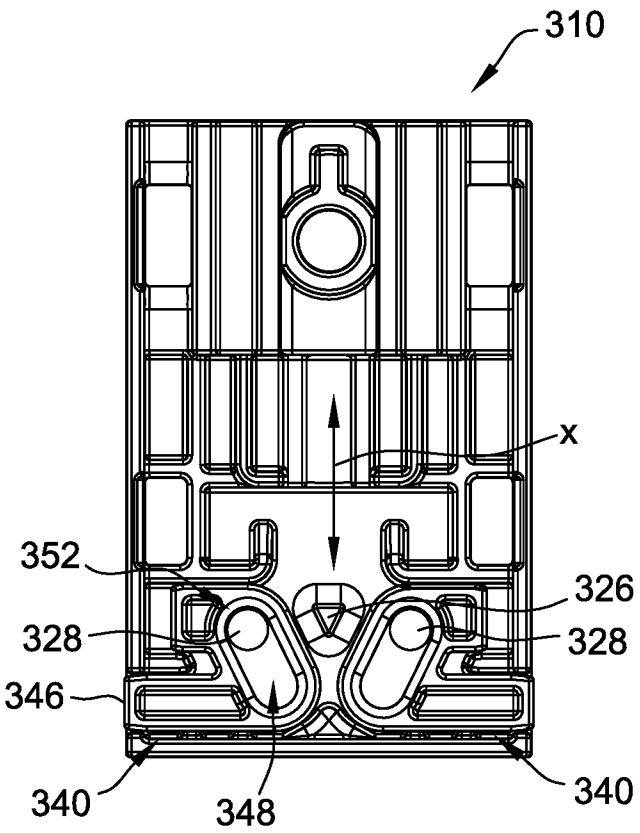
FIG. 15B is a cross-sectional view of the assembled actuator assembly shown in FIG. 15A with the locking tabs in the retracted position.
Figure 15A:
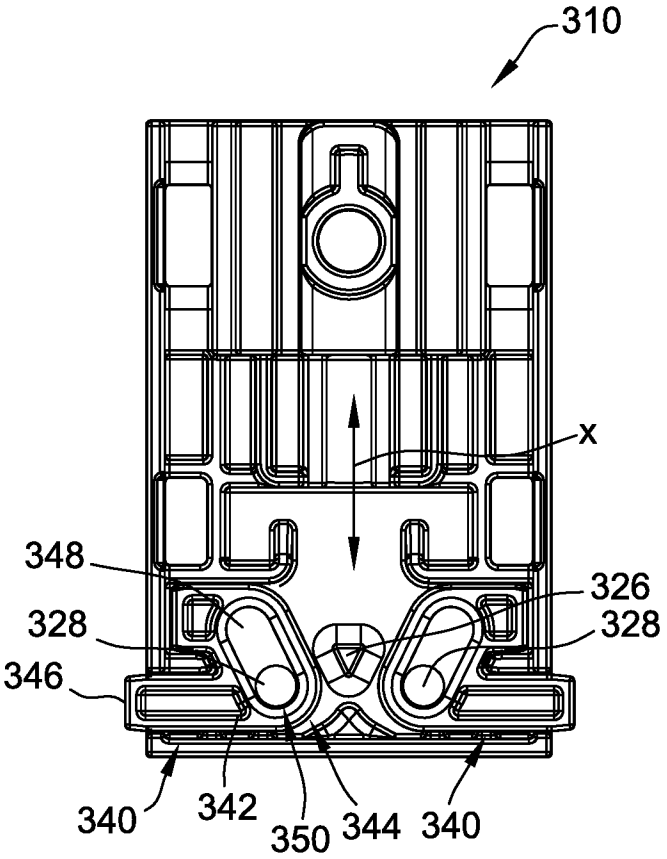
FIG. 15A is a cross-sectional view of the assembled actuator assembly shown in FIG. 11 with the locking tabs in the extended position.

FIG. 15A is a cross-sectional view of the actuator assembly 310 in an assembled state, where the locking tabs 340 are shown in the extended position. Each pin 328 is disposed within one of the locking tab channels 348 when the actuator assembly 310 is assembled. When the locking tab 340 is in the extended position, the pin 328 is located adjacent the first end 350 of the channel 348, and the distal end 346 of each locking tab 340 protrudes from the actuator housing 308. As shown in FIG. 15B, when the locking tabs 340 are moved to the retracted position (e.g., by actuation of the actuator 320), the locking tabs 340 are retracted within the actuator housing 308 such that the locking tabs 340 are partially or fully disposed within the actuator housing 308.

Figure 17:
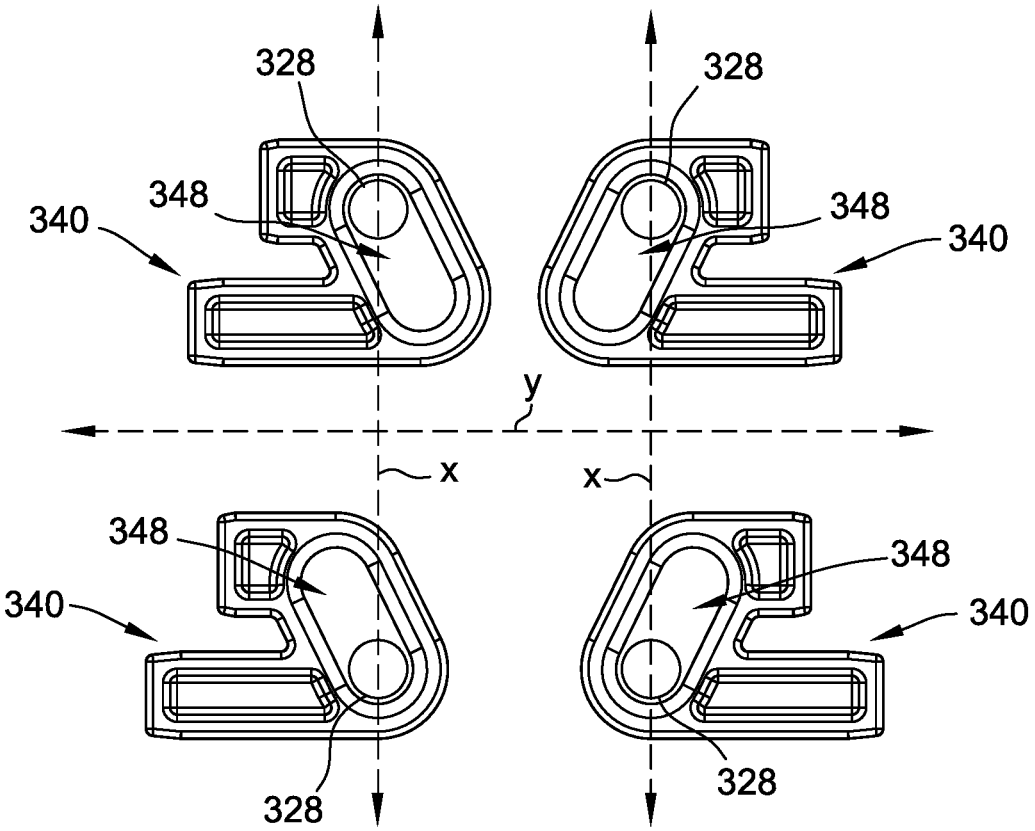
FIG. 17 is a simplified view of the locking tabs and a portion of the actuator shown in FIGS. 14A and 14B, illustrating the interaction between the locking tabs and the actuator and the resulting movement of the locking tabs between the extended position and the retracted position.

As shown in FIGS. 15-17, movement of the actuator 320 in the longitudinal direction x relative to the locking tabs 340 causes the locking tabs 340 to move between the extended position and the retracted position. More specifically, when the actuator 320 is moved in the longitudinal direction x, each pin 328 of the actuator 320 moves through its corresponding channel 348 and engages the body 342 of the locking tab 340. Because the channels 348 are oriented at an oblique angle relative to the longitudinal direction x, the pins 328 force the locking tabs 340 laterally inwards as the actuator 320 and the pins 328 move in the longitudinal direction x. Thus, longitudinal movement of the actuator 320 is translated into lateral movement of the locking tabs 340.

Movement of the actuator 320 in the longitudinal direction x additionally causes movement of the wedge 326 in the longitudinal direction x. As the actuator 320 moves from the initial position to the actuated position, the wedge 326 moves longitudinally away from the locking tabs 340 and vacates space for the locking tabs to move inward into the retracted position. As the actuator 320 moves from the actuated position to the initial position, the wedge 326 moves longitudinally towards the locking tabs 340, pushing them outward into the extended position.

The actuator assembly 310 also includes a spring 325 (FIGS. 16A and 16B) disposed about the stem 324. The spring 325 is positioned between a portion of the actuator 320 and the actuator housing 308 such that the spring 325 biases the actuator 320 towards the initial position, and thereby biases the locking tabs 340 towards the extended position. In the illustrated embodiment, moving the actuator 320 longitudinally away from the locking tabs 340 compresses the spring 325. To maintain the actuator 320 in the actuated position and the locking tabs 340 in the retracted position, a force must be continuously applied to the actuator 320. In the illustrated embodiment, the stem 324 also functions as a stop by limiting the motion of the actuator 320 in the longitudinal direction x. Specifically, as the actuator 320 moves towards the actuated position, the stem 324 contacts a portion of the actuator housing 308 (the rear actuator housing portion 314 in the illustrated embodiment), thereby preventing further movement of the actuator 320 and further compression of the spring 325.

As noted above, the actuator 320 of the illustrated embodiment is moved or actuated away from the locking tabs 340 to move the locking tabs from the extended position to the retracted position. Other embodiments can include an actuator that is moved longitudinally towards the locking tabs 340 to move the locking tabs 340 from the extended position to the retracted position.

Figure 18B:
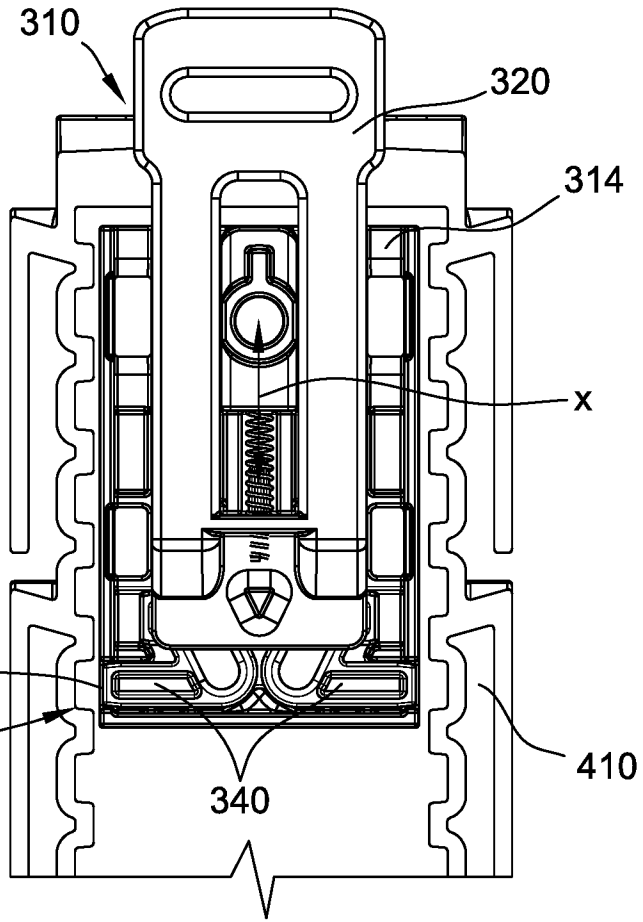
FIG. 18B is a front view of the actuator assembly connected to the track shown in FIG. 7, with the locking tabs in the retracted position.
Figure 18A:
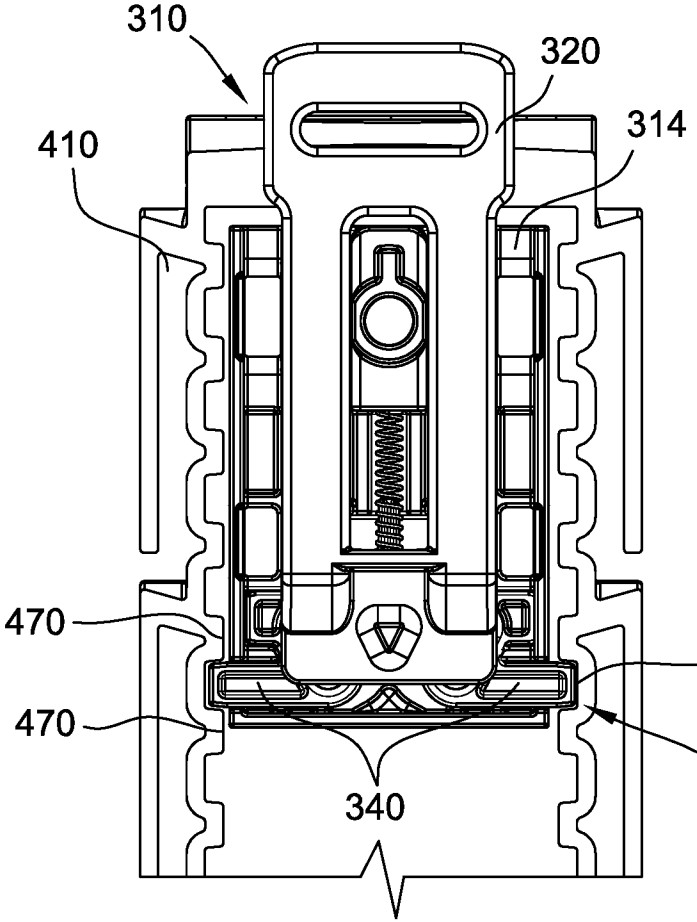
FIG. 18A is a front view of the actuator assembly connected to the track shown in FIG. 7, with the locking tabs in the extended position.

FIG. 18A is a front view of the actuator assembly 310 connected to the track 410, with the actuator 320 in the initial position and the locking tabs 340 in the extended position. The actuator assembly 310 is movably connected to the track 410 and, more specifically, is selectively repositionable along the track 410 in the longitudinal direction x. Selectively repositioning the actuator assembly 310 along the track 410 allows the height of the harness assembly 14 to be adjusted. More specifically, the shoulder straps 24 of the harness assembly 14 are connected to the actuator assembly 310 by the mounting plate 305 such that movement of the actuator assembly 310 along the track 410 adjusts a height or position of the harness assembly 14 relative to the housing 32.

When the locking tabs 340 are in the extended position, each locking tab 340 is positioned within one indentation 474 of the track 410 and engaged with at least one tooth 470 defining the indentation 474. The engagement of the locking tabs 340 and teeth 470 prevents movement of the actuator assembly 310 in the longitudinal direction x, thus locking it in position. When the actuator 320 is moved or actuated to the second, actuated position (shown in FIG. 18B), the locking tabs 340 simultaneously move to the retracted position, such that they are out of the indentations 474 and disengaged from the plurality of teeth 470. In this position, the actuator assembly 310 is free to move along the track 410 in the longitudinal direction x such that a user may selectively position the actuator assembly 310 at a desired position or height along the track 410. When the actuator assembly 310 is at the desired position, the user may release the actuator 320, which is biased towards the initial position by the spring 325. The actuator 320 will then move to the initial position, causing the locking tabs 340 to move to the extended position and engage the teeth 470 of the track 410.

Embodiments of the connection systems and harness adjustment assemblies described herein provide several advantages over prior designs. For example, harness adjustment assemblies of the present disclosure can be assembled and adjusted with minimal additional tools and hardware. Embodiments of the connection systems utilize part geometry, rather than extra fasteners, to maintain engagement between the housing and the harness adjustment assembly. For example, housing ribs and track slots hold the system together such that no more than one additional fastener is needed in some embodiments. Such a construction reduces cost and labor of assembling the system by requiring only one point of attachment. Harness adjustment assemblies of the present disclosure can be repositioned during use, without time-consuming disassembly and reassembly to adjust the harness to a different height.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A harness adjustment assembly for a user-worn electrical appliance, the harness adjustment assembly comprising:

a track sized and shaped to be received within a recess of a housing of the electrical appliance and including:

a pair of laterally opposed side rails, each side rail having a plurality of slots defined therein and extending laterally inward from an outer edge of the side rail, wherein each slot extends from a rear of the track towards a front of the track at an oblique angle relative to a longitudinal direction of the track, and wherein each slot is sized, shaped, and positioned to receive one of a plurality of ribs extending into the recess of the electrical appliance housing to connect the track to the electrical appliance housing; and a plurality of teeth arranged in at least one row extending in the longitudinal direction, wherein each pair of adjacent teeth defines an indentation therebetween; and an actuator assembly movably connected to the track, the actuator assembly comprising:

at least one locking tab movable between an extended position, in which the locking tab is positioned within one indentation and engaged with at least one tooth defining the indentation, and a retracted position, in which the locking tab is disengaged from the plurality of teeth; and an actuator removably connected to the at least one locking tab and configured to move in the longitudinal direction relative to the at least one locking tab, wherein movement of the actuator in the longitudinal direction relative to the at least one locking tab causes the at least one locking tab to move towards the retracted position and disengage from the plurality of teeth to enable the actuator assembly to move along the track.

2. The harness adjustment assembly of claim 1, wherein movement of the actuator in the longitudinal direction away from the at least one locking tab causes the at least one locking tab to move towards the retracted position.

3. The harness adjustment assembly of claim 1 further comprising a harness mounting plate removably connected to the actuator assembly, the harness mounting plate adapted for connection to a harness assembly.

4. The harness adjustment assembly of claim 3, wherein the actuator assembly further comprises an actuator housing having an attachment feature, wherein the harness mounting plate is removably connected to the actuator housing by the attachment feature such that movement of the actuator assembly causes movement of the harness mounting plate.

5. The harness adjustment assembly of claim 1, wherein the actuator assembly comprises a spring that biases the at least one locking tab towards the extended position.

6. The harness adjustment assembly of claim 5, wherein the actuator further comprises a stem, the spring disposed about the stem, wherein the stem is positioned to contact an actuator housing of the actuator assembly to limit movement of the actuator in the longitudinal direction.

7. The harness adjustment assembly of claim 1, wherein each of the at least one locking tab includes a body extending from a proximal end to a distal end, wherein the body has a channel defined therein adjacent the proximal end, wherein the actuator comprises at least one pin disposed within the channel of each of the at least one locking tab, and wherein movement of the actuator in the longitudinal direction causes the at least one pin to engage the body of each of the at least one locking tab to move the at least one locking tab from the extended position to the retracted position.

8. The harness adjustment assembly of claim 7, wherein the channel is defined at an oblique angle relative to the longitudinal direction.

9. The harness adjustment assembly of claim 8, wherein the angle is in the range of 15° to 45°.

10. The harness adjustment assembly of claim 1, wherein the pair of laterally opposed side rails are spaced from one another to define a longitudinally extending channel therebetween, wherein the actuator assembly is moveable within the longitudinally extending channel in a first longitudinal direction and an opposing second longitudinal direction when the at least one locking tab is disengaged from the plurality of teeth, and wherein each tooth of the plurality of teeth is oriented perpendicular to the longitudinally extending channel such that the at least one locking tab inhibits movement of the actuator assembly in both the first and second longitudinal directions when the at least one locking tab is engaged with at least one tooth.

11. A connection system for a user-worn electrical appliance, the connection system comprising:

a housing of the electrical appliance, the housing having a user-facing side that faces or engages a user when worn by the user, the housing comprising an outer surface, a recessed surface, and a pair of laterally-opposed recess sidewalls that extend into the housing from the outer surface to the recessed surface, wherein the pair of recess sidewalls and the recessed surface at least partially define a recess therebetween and extending into the housing from the user-facing side, wherein the housing comprises a plurality of ribs extending laterally into the recess from each of the pair of recess sidewalls; and a track removably connected to the housing within the recess, wherein the track comprises a pair of laterally opposed side rails, each side rail having a plurality of slots defined therein, wherein each slot is sized, shaped, and positioned to receive one of the plurality of ribs therein;

wherein, when the electrical appliance is worn by the user, the weight of the electrical appliance causes a reactive force between the plurality of ribs and the side rails to urge the track towards the recessed surface.

12. The connection system of claim 11, wherein each of the plurality of ribs extends at a downward angle from a first end proximate the recessed surface to a second end positioned proximate a front of the recess.

13. The connection system of claim 12, wherein the downward angle is in the range of 30° to 75° relative to the recessed surface.

14. The connection system of claim 11, wherein a single fastener secures the track to the housing of the user-worn electrical appliance.

15. The connection system of claim 14, wherein the housing defines a first fastener opening, wherein the track defines a second fastener opening, and wherein the first and second fastener openings are aligned to receive the fastener to secure the track to the housing.

16. The connection system of claim 11, wherein each of the plurality of ribs has a tapered increasing thickness as the rib extends laterally from the recess sidewall into the recess.

17. The connection system of claim 11, wherein the electrical appliance is a backpack vacuum cleaner, and wherein the housing defines a debris chamber for storing debris collected by the backpack vacuum cleaner.

18. A system comprising:

an electrical appliance comprising a housing, the housing comprising a pair of laterally-opposed recess sidewalls defining a recess therebetween;

a track removably connected to the housing within the recess;

a harness adjustment assembly connected to the housing by the track, the harness adjustment assembly comprising an actuator assembly movable and selectively repositionable along the track; and a harness assembly configured to be worn by a user of the electrical appliance to facilitate carrying the electrical appliance, wherein the harness assembly is connected to the actuator assembly such that the harness assembly is selectively repositionable relative to the electrical appliance housing upon actuation of the actuator assembly.

19. The system of claim 18, further comprising a harness mounting plate connected to the actuator assembly, wherein the harness assembly is connected to the actuator assembly by the harness mounting plate.

20. The system of claim 18 wherein the electrical appliance is a backpack vacuum cleaner, and wherein the backpack vacuum cleaner comprises a housing defining a debris chamber for storing debris collected by the backpack vacuum cleaner.

21. The system of claim 18 wherein the housing includes a plurality of ribs, and wherein the track includes a plurality of slots defined therein, wherein each slot is sized, shaped, and positioned to receive one of the plurality of ribs therein, wherein, when the electrical appliance is worn by the user, the weight of the electrical appliance causes a reactive force between the plurality of ribs and the track to urge the track towards the housing.

* * * * *